US006322639B1

(12) United States Patent
Matsuzaki et al.

(10) Patent No.: US 6,322,639 B1
(45) Date of Patent: Nov. 27, 2001

(54) MAGNETIC STEEL SHEET HAVING EXCELLENT MAGNETIC PROPERTIES AND METHOD OF PRODUCING THE SAME

(75) Inventors: Akihiro Matsuzaki; Osamu Kondo; Takako Yamashita; Shigeaki Takajo, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/462,296

(22) PCT Filed: May 18, 1999

(86) PCT No.: PCT/JP99/02585

§ 371 Date: Jan. 4, 2000

§ 102(e) Date: Jan. 4, 2000

(87) PCT Pub. No.: WO99/60182

PCT Pub. Date: Nov. 25, 1999

(30) Foreign Application Priority Data

| | | |
|---|---|---|
| May 18, 1998 | (JP) | 10-135241 |
| Jul. 29, 1998 | (JP) | 10-213883 |
| Nov. 26, 1998 | (JP) | 10-335091 |
| Nov. 26, 1998 | (JP) | 10-335093 |
| Mar. 16, 1999 | (JP) | 11-070179 |

(51) Int. Cl.[7] ..... H01F 1/12

(52) U.S. Cl. ..... 148/308; 148/306; 148/111; 148/120

(58) Field of Search ..... 148/306, 307, 148/308, 110, 111, 112, 120

(56) References Cited

FOREIGN PATENT DOCUMENTS

| | | |
|---|---|---|
| 2-274812 | 11/1990 | (JP) . |
| 6-220537 | 8/1994 | (JP) . |
| 7-138641 | 5/1995 | (JP) . |
| 7-173542 | 7/1995 | (JP) . |
| 7-268469 | 10/1995 | (JP) . |
| 10-226854 | 8/1998 | (JP) . |
| 11-61357 | 3/1999 | (JP) . |

*Primary Examiner*—John Sheehan
(74) *Attorney, Agent, or Firm*—Schnader Harrison Segal & Lewis LLP

(57) ABSTRACT

A magnetic steel sheet used for an alternating current core, and having excellent magnetic properties in both a rolling direction, and the direction perpendicular thereto, and a method of producing the magnetic steel sheet. The magnetic steel sheet in a recrystallized cold-rolled condition is characterized in that the intensity ratio of {100}<001> orientation to random orientation is 2.0 or more, the intensity ratio of {011}<100> orientation to random orientation thereof is 2.0 to 10.0, and the intensity ratio of <001>//ND orientation to random orientation is preferably 2.0 or less. The method of producing a magnetic steel sheet includes hot-rolling a silicon steel slab so that the intensity ratio of (015)[100] orientation to random orientation of the recrystallized hot-rolled sheet is 3.0 or more.

8 Claims, 3 Drawing Sheets

MAGNETIC STEEL SHEET HAVING EXCELLENT MAGNETIC PROPERTIES AND METHOD OF PRODUCING THE SAME

TECHNICAL FIELD

The present invention relates to a magnetic steel sheet used for an alternating-current magnetic core and having excellent magnetic properties in two directions including a rolling direction (referred to as "the L direction" hereinafter) and the direction perpendicular thereto (referred to as "the C direction" hereinafter), and a method of producing the same.

BACKGROUND ART

Core materials of a transformer and an electric motor are required to have a high magnetic flux density and low iron loss in order to increase the efficiency of these devices and miniaturize the devices.

As magnetic alloys supplied as such core materials, Fe-Si alloys and the like are known, and widely brought into practical use as non-oriented magnetic steel sheets. Namely, the method of increasing the amount of Si or Al added is known as a method having the effect of increasing resistivity to decrease an eddy current loss, and widely used. However, addition of an alloy component such as Si, Al, or the like decreases the saturation magnetic flux density. The method of increasing the amount of Si or Al added is difficult to satisfy both a low iron loss and high magnetic flux density.

An example of methods of improving an iron loss without adding an alloy component such as Si, Al, or the like is a method comprised of applying several % skin pass rolling to a cold rolled and annealed sheet, stamping by a user, and then applying stress relief annealing. However, this method requires a finish hot rolling temperature of 800° C. or more, 75% or more of cold rolling, and high-temperature annealing for a shot time, as well as several % skin pass rolling. When a coiling temperature after hot rolling is low and recrystallization is insufficient, this method also requires a hot-rolled sheet annealing. Therefore, the method has disadvantages in which the production process is significantly complicated, and the production cost is increased.

Japanese Examined Patent Publication No. 7-23509 discloses a method of improving magnetic properties without complicating the production process. This publication discloses that the Si amount is decreased to 1% or less, and ferrite coarse particles are rolled in a hot rolling step between rough hot rolling and finish hot rolling, improving both an iron loss and a magnetic flux density. However, this method increases less resistivity because the Si content is as low as 1% or less, and thus it cannot sufficiently decrease an iron loss. As a result of investigation, the inventors found that even when this method is applied to steel containing over 1% or Si, the sufficient effect on improving magnetic properties cannot be obtained.

Various attempts have been made to improve a texture. Japanese Unexamined Patent Publication No. 54-110121 discloses that an iron loss is decreased, and particularly, a magnetic flux density is increased when crystal grains in the {011}<100> orientation, i.e., the Goss orientation, are enriched. The Goss orientation generally improves magnetic properties in the L direction, and consequently improves average magnetic properties including those in the C direction. However, the magnetic properties in the C direction are improved only to some extent, and thus improvement in average magnetic properties is limited.

On the other hand, {100}<001> orientation, i.e., regular cubic orientation, is known to simultaneously improve magnetic properties in the two directions including the L direction and the C direction. However, in order to obtain a structure integrated only in the regular cubic orientation, a complicated, long-term and high-cost process is required, such as the high-temperature region intermediate annealing method disclosed in Japanese Examined Patent Publication No. 46-23814, the bidirectional rolling method disclosed in Japanese Unexamined Patent Publication No. 5-271883, the quenched ribbon method disclosed in Japanese Unexamined Patent Publication No. 5-306438, the method of $\gamma \rightarrow \alpha$ transformation accompanied by decarbonization disclosed in Japanese Unexamined Patent Publication No. 1-108345, etc., thereby failing to establish industrial practicability.

Furthermore, as means for improving magnetic properties, it is useful to accelerate the production of crystal gains in the orientation in which magnetic properties are improved, and suppress the production of crystal grains in the orientation in which magnetic properties are deteriorated. Particularly, crystal grains in the orientation in which magnetic properties are deteriorated include crystal grains in the <111>//ND (the direction perpendicular to a steel sheet plane) orientation. It is preferable to suppress the crystal grains in this orientation, but the above-described special means and high-cost process are required. Therefore, the conventional process for producing a non-oriented magnetic steel sheet is difficult to decrease the grains in the <111>//ND orientation.

Namely, magnetic steel sheets produced in these methods cannot satisfy a low iron loss which is required from the viewpoint of global environment and energy environment at present.

DISCLOSURE OF INVENTION

An object of the present invention is to make an appropriate texture by hot rolling under appropriate conditions to achieve a low iron loss and a high magnetic flux density, and decrease cost by simplifying the production process.

The present invention relates to a magnetic steel sheet having excellent magnetic properties in the L direction and the C direction, wherein the structure of a recrystallized cold-rolled sheet has a ratio of {100}<001> orientation intensity to random orientation intensity ratio of 2.0 or more, and a ratio of {011}<100> orientation intensity to random orientation intensity of 2.0 to 10.0. The structure of a recrystallized cold-rolled sheet preferably has a ratio of <111>//ND orientation intensity to random orientation intensity of 2.0 or less. The present invention also relates to a method of producing a magnetic steel sheet having excellent magnetic properties in the L direction and the C direction, the method comprising hot-rolling silicon steel slab so that the structure of a recrystallized hot-rolled sheet has a ratio of (015)[100] orientation intensity to random orientation intensity of 3.0 or more, wherein the structure of a recrystallized cold-rolled sheet has a ratio of {100}<001> orientation intensity to random orientation intensity of 2.0 or more, and a ratio of {011}<100> orientation intensity to random orientation intensity of 2.0 to 10.0. In order that the structure of a recrystallized hot-rolled sheet has a ratio of (015)[100] orientation intensity to random orientation intensity of 3.0 or more, the structure after hot rough rolling, hot finish rolling conditions, the structure of a steel sheet on the delivery side of a final stand of a finish hot rolling mill, and the amount of effective accumulated stress (Q) of a steel sheet at the entrance side of the final stand of the finish hot rolling mill are optimized.

The inventors extensively studied means for practically improving magnetic properties of a non-oriented magnetic steel sheet. As a result, it was found that when a rolling reduction of one pass of hot rolling is set to a sufficiently large value, the degree of integration in the regular cubic orientation is increased. This was proposed in Japanese Application No. 9-244216. In advancing this study, a production method was extensively studied, in which a practical texture can be selected, and the existing process for producing a magnetic steel sheet can be used.

In study of the selection of a practical texture, it was found that a magnetic steel sheet having excellent average magnetic properties in the L direction and C direction can be obtained by increasing the degrees of integration in both the Goss orientation ({011}<100> orientation) and the regular cubic orientation ({100}<001> orientation). It was also found to be more preferable to suppress the degree of integration in the <111>//ND orientation.

The {100}<001> orientation is favorable for improving magnetic properties in the L direction and the C direction. The {011}<100> orientation is favorable for improving magnetic properties in the L direction. While, the <111>// ND orientation most decreases planar magnetic properties. By a conventional technique, grains integrated in the {100}<001> orientation and in the {011}<100> orientation at a high degree cannot be obtained. The inventors formed experimental steel sheets integrated in these two orientations under various conditions. As a result of evaluation of performance, it was found that magnetic properties in the L direction and the C direction can be significantly improved by controlling the integrated intensity of crystal grains in these two orientations. It was also found that a steel sheet maintaining the integrated intensity in these two orientations with the integrated intensity of grains in the <111>//ND orientation suppressed can be produced. It was further found that magnetic properties in the L direction and the C direction can further be improved by controlling these three orientations.

In addition, as a result of detailed examination of the relations between finish hot rolling conditions, the microstructure, and the texture in order to form the above-described texture, a production method was established, to which the existing process for producing a magnetic steel sheet can be applied.

The magnetic steel sheet and the method of producing the same were obtained on the basis of the following knowledge:

On the basis of conventional knowledge, in rolling coarse grains, heterogeneous distortion zones such as a shear zone are readily formed in the grains, and recrystallization from the heterogeneous distortion zones in the grains is accelerated in a subsequent recrystallization step. The inventors found that hot rolling under proper conditions decreases the heterogeneous distortion zones, and suppresses recrystallization in the grains in the subsequent recrystallization step. At the same time, the inventors found that recrystallization from the grain boundaries is accelerated. It was also found that the recrystallized grains in the grain boundaries have a high frequency of the presence of (015)[100] orientation grains. It was further found that the presence of such orientation grains causes an increase in (001)[100] orientation after cold rolling and annealing, and tends to decrease grains in the <111>//ND orientation. It was also determine the amount of (015)[100] orientation required for exhibiting excellent magnetic properties.

Known documents (Taoka et al: Iron and Steel, 54(11968), 162.) disclose the point that (015)[100] orientation grains produce (001)[100] orientation grains by passing through cold rolling and recrystallization annealing. However, an industrial composition and production method capable of producing (015)[100] orientation grains, and the influences of (015)[100] grains on final magnetic properties and texture are not at all known.

The inventors found new hot rolling conditions required for producing (015)[100] grains and control of a hot-rolled steel sheet structure. Namely, the conditions (a), (b) and (c) below are simultaneously satisfied.

(a) Before finish hot rolling, the volume fraction of equiaxed ferrite grains is 80% or more, the average grain size of equiaxed ferrite grains is 300 $\mu$m or more, and the volume fraction of equiaxed ferrite grains having a grain size of 100 $\mu$m or less is 20% or less.

(b) At the entrance side of a finish hot rolling mill, the temperature of a steel sheet is lower than the $A_{r1}$ transformation temperature, and in the range of 500° C. to 900° C. for steel having a composition causing phase transformation; the temperature is in the range of 500° C. to 900° C. for steel having a composition causing no phase transformation.

(c) The rolling reduction of finish rolling is at least 30%.

It was further found that it is more preferable to satisfy any one of the following finish rolling conditions (A) to (D) below.

(A) The ratio of the thickness reduction strain rate Z to the rolling reduction R in a finish rolling stand satisfies the following formula 1:

$$Z/R \geqq 0.51-0.04[Si] \qquad \text{Formula 1}$$

(B) The rolling reduction in a first stand of the finish rolling mill is 15% to 30%.

(C)(i) The total rolling reduction of finish hot rolling is 70% or more and less than 90%.

(ii) The average interlayer spacing of unrecrystallized elongated ferrite grains in a steel sheet on the delivery side of the final stand of the finish hot rolling mill is 250 $\mu$m or more.

(D)(i) At the entrance side of the final stand of the finish hot rolling mill, a steel sheet has an amount of effective accumulated strain Q of 1.0 or more, which is defined by the following formula 2 in consideration of release of strain energy by recovery between the stands.

$$Q = \sum_{i=1}^{f-1} \epsilon_i(0)\ \exp(-(t_i/\tau_R)^{0.1}) \qquad \text{Formula 2}$$

(ii) The rolling reduction of the final stand of the finish hot rolling mill is 20% or more.

Each of the requirements of the present invention will be described based on experimental results.

The texture of a product sheet is described.

The inventors found that in order to improve magnetic properties in the L direction and the C direction, it is necessary that the integrated intensities in the {100}<001> orientation and {011}<100> orientation are in the range of not less than 2.0 times and 2.0 to 10.0 times, respectively, as high as the integrated intensity of a random structure. It was also found that the average integrated intensity in the <111>//ND orientation is more preferably in the range of not more than 2.0 times as high as the integrated intensity of the random structure. The experimental results are described-:below.

A 50 kg-weighed steel ingot having a composition containing 2.1 wt % of Si was melted in a vacuum small melting furnace, and then rolled into a sheet having a thickness of 3.5 mm by hot rough rolling. The steel sheet was heated at 1150° C. for 30 minutes, subjected to 2 passes of hot finish rolling at a rolling reduction of 35%/pass, and then air-cooled to produce a hot-rolled sheet having a thickness of 1.5 mm. At this time, the hot rolling temperature and the rolling rate were changed to various values to produce steel sheets having different textures after finish annealing. In any one of the steel sheets, ferrite grains before hot finish rolling contained 100% equiaxed grains, the average grain size of ferrite grains was 1000 μm, and the volume fraction of grains of 100 μm or less was 1% or less. The hot-rolled sheet was then annealed at 1000° C. for 1 minute, pickled, and then cold-rolled to a final thickness of 0.5 mm, followed by finish annealing at 900° C. for 30 seconds. Table 1 shows the results of evaluation of the textures and magnetic properties of the thus-produced steel sheets.

Table 1 indicates that in steel types G to J and L to Q in which the integrated intensities in the {100}<001> orientation and the {011}<100> orientation are not less than 2.0 times and 2.0 to 10.0 times, respectively, as high as the integrated intensity of the random structure, magnetic properties in the L direction and the C direction, i.e., average magnetic properties in the LC directions, are excellent as compared with steel types A to F in which the integrated intensity ratio in at least one of the two orientations is 2.0 or less. It is also found that in steel type K in which the integrated intensity ratio in the {011}<100> orientation exceeds 10 times, properties in the L direction are excellent, while magnetic properties in the C direction are poor, thereby failing to improve the average properties in the LC directions. It is also apparent that in steel types H to J in which the integrated intensity in the <111>//ND orientation is not more than 2.0 times as high as the integrated intensity of the random structure, the average properties in the LC directions are further improved as compared with steep type G in which the integrated intensity ratio exceeds 2.0 times.

Next, studies were carried out on production conditions for attaining the above texture conditions in which the integrated intensities in the {100}<001>orientation and the {011}<100> orientation are not less than 2.0 times and 2.0 to 10.0 times, respectively, as high as the integrated intensity of the random structure, and the integrated intensity in the <111>//ND orientation is more preferably not more than 2.0 times as high as the integrated intensity of the random structure. The results of experiment are described below.

The chemical components (wt %) of steel, the volume fraction (%) of recrystallized ferrite grains having a grain size of 100 μm or less immediately before hot finish rolling, the total rolling reduction (%) of hot finish rolling, the hot finish rolling temperature (° C.), and the $A_{r1}$ transformation temperature (° C.) of each of steel specimens are shown in Table 2. Continuously cast slab of each of these materials was re-heated in the range of 1000° C. to 1250° C., and then finished to a hot-rolled sheet having a thickness of 2.5 mm by hot rough rolling and subsequent hot finish rolling. Then, the hot-rolled sheet was finished to a final thickness of 0.5 mm by cold rolling. After cold rolling, recrystallization treatment was carried out by continuous annealing at 800 to 900° C. for 1 minute. With some of the materials, continuously hot-rolled sheet annealing was performed at 700 to 1000° C. for 10 minutes. For each of the thus-produced specimen steel sheets, iron losses W15/50 and the magnetic flux density B50 in both L direction and C direction, were measured, and magnetic properties were evaluated. The results of the evaluation are shown in Table 2. The results of examination of the textures of the hot-rolled sheets and the cold-rolled annealed sheets which were subjected to recrystallization are also shown in Table 2.

All steel Nos. 1 to 11 contain 1.17 wt % of Si. Of these steels, steel Nos. 1 to 4 and Nos. 6 to 8 exhibit excellent magnetic properties as compared with steel Nos. 5 and 9 to 11 having the same Si content. In steel No. 5, a total rolling reduction in finish rolling is 30% or less. In steel Nos. 9 and 10, the volume fraction of recrystallized ferrite grains having a grain size of 100 μm or less immediately before finish rolling exceeds 20%. In No. 11, the finish rolling temperature is higher than the $A_{r1}$ transformation temperature. In Nos. 12 and 13, the Si content is lower than the optimum range of the present invention, and the volume fractions of recrystallized ferrite grains having a grain size of 100 μm or less immediately before finish rolling are 0% and 35%, respectively. The magnetic properties of Nos. 12 and 13 are not improved. In steel Nos. 14 and 15, the Si content is 1.65% in the proper range of the present invention, and the volume fractions of recrystallized ferrite grains having a grain size of 100 μm or less immediately before finish rolling are 0% and 23%, respectively. Steel No. 14 having a volume fraction of 20% or less exhibits excellent magnetic properties as compared with steel No. 15 having a volume fraction of over 20%. Steel Nos. 16 to 20 are steel comprising a ferrite single phase. Both steel Nos. 16 and 17 have a Si content of 1.85% in the proper range of the present invention. In steel Nos. 16 and 17, the total rolling reductions of finish rolling are 97% and 25%, respectively. Steel No. 16 showing a total rolling reduction of 30% or more exhibits excellent magnetic properties as compared with steel No. 17 showing a total rolling reduction of less than 30%. Steel Nos. 18 to 20 have Si contents of as high as 2.10%, 3.20% and 3.4%, respectively, and thus exhibit, particularly, the significant effect of improving an iron loss. In Steel Nos. 18 to 20, the magnetic flux density is maintained at the same level as steel Nos. 12 and 13 having a Si content of as low as 0.82%. Steel Nos. 21 to 24 are examples of the present invention. No. 21 is an example in which the C amount is in the preferable range (0.005%), No. 22 is an example in which the C amount is in the more preferable range (0.002%), No. 23 is an example in which the P amount is in the optimum range (0.130%), and No. 24 is an example in which both the C amount (0.002%) and P amount (0.120%) are in the optimum ranges. In comparison between steel Nos. 21 and 22, No. 22 having a C amount decreased to 0.002% has excellent magnetic properties. In comparison between steel Nos. 21 and 23, No. 23 having a P amount in the optimum range has excellent magnetic properties. In comparison between steel Nos. 22 or 23 and 24, No. 24 having both C and P amounts in the optimum ranges has significantly improved magnetic properties.

In consideration of the textures, in all steel types having improved properties, the intensity ratio in the (015)[100] orientation of the recrystallized hot-rolled sheet is 3 or more. In the recrystallized cold-rolled sheet, the integrated intensities in the {100}<001>orientation and the {011}<100> orientation are not less than 2.0 times and 2.0 to 10.0 times, respectively, as high as the integrated intensity of the random structure, and the integrated intensity in the <111>//ND orientation is not more than 2.0 times as high as the integrated intensity of the random structure.

As described above, the inventors examined the detailed relations between the grain size before rolling in the temperature region below the $A_{r1}$ transformation temperature and the recrystallization texture after rolling or the texture of a product sheet with respect to steel having a composition causing austenite-ferrite transformation. As a result, it was found that by limiting the volume fraction of recrystallized microcrystal grains to a certain value or less, and controlling the finish rolling temperature and the rolling reduction in predetermined ranges, it is possible to produce a product sheet having a texture preferable for magnetic properties in which the {100}<001> orientation is significantly developed.

It has been conventionally reported that the orientation of recrystallized grains produced by rolling coarse grains is mainly the {110} orientation. The inventors examined in detail the influences of the volume fraction of fine grains in the coarse grain structure, the finish hot rolling temperature, and the rolling reduction on the recrystallized texture. As a result, it was found that hot finish rolling of coarse grains in predetermined condition ranges produce the {015}<100> orientation as the main orientation of the recrystallized texture. It was also found that with the {015}<100> orientation as the main orientation, the texture of the final product after subsequent cold rolling and annealing is a texture in which the main orientation is the {100}<001> orientation advantageous for magnetic properties. As the density of grains in the {015}<100> orientation in a steel sheet before cold rolling increases, the density of regular Cube (regular cubic orientation) after cold rolling and finish annealing increases, and the <111>//ND orientation decreases, improving magnetic properties. Therefore, the integrated intensity in the {015}<100> orientation in a steel sheet before cold rolling is preferably in the range of not less than 3.0 times as high as the integrated intensity of the random structure.

Namely, it was found that the grain size distribution of recrystallized ferrite grains present in steel before finish rolling performed at the $A_{r1}$ transformation temperature or less significantly influences the subsequent formation of the texture, and that a structure containing recrystallized ferrite grains of 100 μm or less in diameter at a volume fraction of 20% or less is subjected to hot finish rolling at a proper rolling temperature and rolling reduction to significantly improve the magnetic property of the final product.

It was further found that with ferrite single-phase steel having a composition causing no transformation, like steel having a composition causing the above-described transformation, the above production method-can significantly improve magnetic property of the final product by setting the volume fraction of recrystallized micro-grains in the same range as the steel having a composition causing the transformation, and setting the finish rolling temperature and the rolling reduction in the predetermined ranges.

On the basis of the above findings, the production method of the present invention mainly comprises processing steel slab to a predetermined steel structure immediately before hot finish rolling, and then applying hot finish rolling under predetermined rolling conditions.

First, before hot finish rolling, steel must have a structure in which the volume fraction of equiaxed ferrite grains is 80% or more, the average grain size of equiaxed ferrite grains is 300 μm or more, and the volume fraction of equiaxed ferrite grains having a grain size of 100 μm or less is 20% or less. Namely, after hot rough rolling, local recrystallization occurs in the grain boundaries of unrecrystallized elongated grains, with no contribution to the formation of grains in the (015)[100] orientation from the grain boundaries after hot finish rolling. Therefore, it is preferable that the volume fraction of equiaxed ferrite grains recrystallized after hot rough rolling is large, specifically 80% or more. With equiaxed ferrite grains having an average grain size of 300 μm or more before hot finish rolling, the amount of grains in the (015)[100] orientation is increased after hot rolling and annealing. Therefore, the average grain size of the ferrite grains is preferably 300 μm or more. However, even with the ferrite grains having an average grain size of 300 μm or more, mixing many fine grains having a grain size of 100 μm or less suppresses the growth of grains in the (015)[100] orientation from coarse grains, thereby deteriorating magnetic properties. Therefore, at the same time, it is preferable to suppress the volume fraction of fine grains, specifically, decrease the volume fraction to 20% or less. As the grain size of the ferrite grains increases, the above effect becomes significant, and the production of grains in the <111>//ND orientation from the grain boundaries in the recrystallization step after hot finish rolling decreases, further improving the texture and magnetic properties of the product. With a large ferrite grain size, recrystallization after hot rolling is suppressed to suppress a decrease in the effect of coarsening grains by recrystallizing micronization between rolling stands, leading to further improvement in magnetic properties. Therefore, the average ferrite grain size is preferably 650 μm or more. This is because with an average ferrite grain size of 650 μm or more, the texture and magnetic properties are improved by a synergistic effect. In this invention, the term "equiaxed ferrite grains" means ferrite grains having a length/breadth ratio of 2 or less. As means for obtaining the above-described structure, for example, a steel sheet may be maintained at an appropriate temperature to be recrystallized after hot rolling, or cooled and then heated again at an appropriate temperature to be recrystallized.

As a first requirement of hot finish rolling conditions, it is necessary that the temperature of a steel sheet at the entrance side of the finish rolling mill is the $A_{r1}$ transformation temperature or less and in the range of 500° C. to 900° C. for steel having a composition causing phase transformation; the temperature is in the range of 500° C. to 900° C. for steel having a composition causing no phase transformation.

In order to effectively utilizing the effect of coarse grains before hot finish rolling, it is important to suppress micronization by recrystallization between the rolling stands, and it is thus effective to apply rolling at low temperature. Therefore, for steel having a composition bearing an austenite phase (causing phase transformation), it is necessary that the upper limit of the finish rolling temperature is the $A_{r1}$ transformation temperature or less and 900° C. or less. While for steel having a composition bearing no austenite phase (causing no phase transformation), it is also necessary that the upper limit of the finish rolling temperature is 900° C. or less. Namely, for steel having a composition causing phase transformation, rolling in the two-phase region or austenite region causes disappearance of the effect due to subsequent transformation, and thus the hot finish rolling temperature must be the ferrite phase region, i.e., lower than the $A_{r1}$ transformation temperature, in order to prevent the disappearance of the effect. In the production method of the present invention, in order that the existence of coarse grains before hot finish rolling, which are an essential specified matter of the present invention, are maintained over the all finish rolling stands, it is important to suppress micronization by crystallization in hot finish rolling. Therefore, it is effective to perform hot rolling at a temperature region as low as possible, and the upper limit thereof is 900° C. With respect to the lower limit of the finish rolling temperature, in any type of steel, rolling in a low temperature region of less than 500° C. increases the amount of accumulated strain, and deteriorates the-texture, and thus the lower limit is 500° C.

As a second requirement of the hot finish rolling conditions, the rolling reduction of hot finish rolling must be at least 30%. With a rolling reduction of hot finish rolling of less than 30%, coarse ferrite grains are grown induced by strain, not broken by rolling, thereby keeping the before-rolling texture, and thus exhibiting no effect of improving magnetic properties by the present invention. Therefore, the lower limit of rolling reduction of hot finish rolling is 30%.

Furthermore, it is preferable to satisfy any of the hot finish rolling conditions (A) to (D) below. This will be described in detail below.

(A) The ratio of the thickness reduction strain rate Z to the rolling reduction R in the hot finish rolling stand satisfies the following formula 1:

$$Z/R \geqq 0.51-0.04[Si] \qquad \text{Formula 1}$$

Rolling reduction in each rolling stand of a hot finish rolling mill: $R\ (\%)=(1-t/t_0)\times 100$;

Thickness reduction strain rate: $Z\ (s^{-1})=\ln(t_0/t)/[\{(d/2)\times \cos^{-1}((d-t_0+t)/d)\}/\{V\times 1000/60\}]$;

$t_0$ and t: thickness (mm) of the entrance side and delivery side of each rolling stand;

d: outer diameter (mm) of a work roll of each stand;

V: carrying velocity (m/minute) of a steel sheet on the delivery side of each stand.

The inventors found the following matters:

1. With a large rolling rate, i.e., a large thickness reduction strain rate Z, heterogeneous deformation in grains is suppressed to promote recrystallization from grain boundaries.

2. When the thickness reduction strain rate Z, the rolling reduction R and the Si amount satisfy a certain formula, grains in the (015)[100] orientation are present at a high frequency in the grains recrystallized from the grain boundaries.

3. The grains in the (015)[100] orientation are grown to {100}<001> oriented grains by subsequent cold rolling and finish annealing, with grains in the <111>//ND orientation suppressed, thereby significantly improving magnetic properties.

Description will now be made of experiments in which a formula between the thickness reduction strain rate Z, the rolling reduction R and the Si amount was found.

50 kg-weighed steel ingot having a composition containing 0.5, 1.0, 1.5, 2.1 or 3.2 wt % of Si was made in a vacuum small melting furnace, and then rolled to a sheet having a thickness of 10 mm by hot rough rolling. In order to obtain a hot-rolled sheet having a final thickness of 1.5 mm (constant), the thickness before hot finish rolling was adjusted by mechanical cutting according to the hot rolling conditions. This cut steel sheet was heated at 1150° C. for 30 minutes, subjected to 1 pass of hot finish rolling at 850° C., and then air-cooled to product a hot-rolled sheet having a thickness of 1.5 mm. At this time, the rolling reduction R and the thickness reduction strain rate Z were changed to various values. The average ferrite grain size immediately before hot finish rolling was 1000 μm. Then, the hot-rolled sheet was annealed in the ferrite single phase region of 850° C. to 1000° C. according to the composition, pickled, and then cold-rolled to obtain a final thickness of 0.5 mm, followed by finish annealing at 850 to 1000° C. for 30 seconds.

Table 3 shows the results of evaluation of the texture and magnetic properties of each of the steel sheets obtained as described above. Of the results shown in Table 3, the averaged iron loss and magnetic flux density of the L direction and C direction are plotted and arranged in FIG. 1. In FIG. 1, steel sheets produced according to the production method of the present invention are marked with black circle, and steel sheets produced under production conditions out of the proper range of the present invention are marked with white circle. As seen from FIG. 1, magnetic properties are divided into two regions including a superior property region and an inferior property region with the line shown in the drawing as a boundary. Table 3 and FIG. 1 indicate that the integrated intensity ratio of grains in the (015)[100] orientation after hot finish rolling and annealing, and-magnetic properties are significantly changed with the Si amount, the rolling reduction, and the strain rate. This is possibly due to the fact that as the ratio of the strain rate to the rolling reduction increases, heterogeneous distortion in grains during hot rolling decreases, and recrystallization from the grain boundaries frequently occurs.

The Si amount also has close relations to the formation of the distorted structure, and the behavior of recrystallization. Therefore, the inventors variously analyzed these relations. The results are shown in FIG. 2. It is apparent that the formation of the distorted structure and the behavior of recrystallization can be explained by Z/R, the ratio of the thickness reduction strain rate Z to the rolling reduction R and the Si content. In FIG. 2, on the basis of the conditions shown in Table 3, steel sheets exhibiting good magnetic properties shown in FIG. 1 are marked with black circle, and the steel sheets exhibiting poor magnetic properties shown in FIG. 1 are marked with white circle. It is thus found that in the production method of the present invention, a condition for exhibiting good magnetic properties is that the ratio Z/R is above the boundary line shown in FIG. 2, i.e., the rolling reduction R at each rolling stand of the finish rolling mill, the thickness reduction strain rate Z, and the Si amount satisfy Formula 1.

(B) The rolling reduction in the first stand of the hot finish rolling mill is 15% to 30%.

In a conventional tandem rolling mill, the rolling reduction in the first stand of a hot finish rolling mill is about 30 to 50%. With a rolling reduction of over 30% in the first stand, the ratio of the hot rolling rate to rolling reduction is decreased at a normal rolling rate, thereby deteriorating the texture and magnetic properties. Therefore, the rolling reduction in the first stand is 30% or less. The rolling reduction in the first stand is preferably 25% or less because of substantially no adverse effect of deteriorating the texture and magnetic properties.

On the other hand, with a rolling reduction of less than 15% in the first stand, the rolling reduction in the second stand or later stand must be increased. Accordingly, the ratio of the rolling rate to the rolling reduction in the second stand or later stand is decreased, resulting in deterioration in magnetic properties. Therefore, the rolling reduction in the first stand is 15% or more.

It will be described in Example 2 that this condition is preferred for improving magnetic properties.

(C) (i) The total rolling reduction of hot finish rolling is 70% or more and less than 90%.

The total rolling reduction of hot finish rolling influences the production of grains in the (015)[100] orientation in the subsequent recrystallization step, and the formation of grains in the other orientations, influencing magnetic properties. Therefore, the total rolling reduction of hot finish rolling is preferably 70% or more and less than 90%. With a total rolling reduction of hot finish rolling of less than 70%, strain is not sufficiently accumulated for recrystallizing grains in the (015)[100] orientation, thereby deteriorating magnetic properties. With a total rolling reduction of hot finish rolling of 90% or more, recrystallization of grains having orientations other than the (015)[100] orientation is increased to further deteriorate magnetic properties.

(ii) The average interlayer spacing of unrecrystallized elongated ferrite grains in a steel sheet on the delivery side of the final stand of the hot finish rolling mill is 250 μm or more.

When the average interlayer spacing of unrecrystallized elongated ferrite grains in a steel sheet on the delivery side of the final stand of the hot finish rolling mill is 250 μm or more, the stability of grains in the (015)[100] orientation produced in the grain boundaries in the subsequent recrystallization step is increased. Therefore, even in complete recrystallization, grains in the (015)[100] orientation remain and improve the texture and magnetic properties. The term "interlayer spacing" means the interlayer spacing in the thickness direction. Namely, the average interlayer spacing of unrecrystallized elongated ferrite grains is 250 μm, preferably in the range of 250 to 500 μm.

The metallurgical relationship between the interlayer spacing of unrecrystallized elongated ferrite grains and the stability of grains in the (015)[100] orientation is not necessarily apparent. However, the inventors considered as follows.

As a result of various researches, the inventors found that grains in the (015)[100] orientation produced in the recrystallization step after hot rolling are mainly produced in the grain boundaries of elongated grains. However, substantially no grain in this orientation is observed in a texture after normal hot-rolling and after recrystallization. Namely, the grains in the (015)[100] orientation are thought to be basically unstable grains. The reason why the grains in the (015)[100] orientation are unstable is possibly that in the recrystallization step after hot rolling, recrystallized grains interfere with each other, and thus the grains in the (015)[100] orientation are readily caught by other orientation grains and disappear. However, when the grains in the (015)[100] orientation produced on the elongated grain boundaries grow to a sufficient size before those grains and adjacent recrystallized grains start interfering with each other, the grains in the (015)[100] orientation become stable due to the size effect, and remain in the interference step. Namely, there is possibly a critical size for allowing the grains in the (015)[100] orientation to remain. On the other hand, as a result of research performed by the inventors, the frequency of nucleation in the elongated grain boundaries after hot rolling of steel, which is an object of the present invention, is not so large. In a conventional production method, the interlayer spacing is generally 50 μm or less. Therefore, in a conventional production method, interference with recrystallized grains produced in the adjacent elongated grain boundaries earlier occurs than interference with adjacent recrystallized grains in the same grain boundaries. Namely, the recrystallized grain size with which interference occurs is controlled by the interlayer spacing of elongated grains.

On the basis of the fact that the grains in the (015)[100] orientation readily remain with an interlayer spacing of unrecrystallized elongated ferrite grains of 250 μm or more, it is understood that this interlayer spacing corresponds to a condition for producing the critical size.

The above-described conditions suitable for improving magnetic properties will be described in Example 3.

(D) (i) At the entrance side of the final stand of the hot finish rolling mill, a steel sheet has an amount of effective accumulated strain Q of 1.0 or more, which is defined by the following formula 2 in consideration of release of strain energy by recovery between the respective stands.

$$Q = \sum_{i=1}^{f-1} \epsilon_i(0)\ \exp(-(t_i/\tau_R)^{0.1}) \qquad \text{Formula 2}$$

$\tau_r = 7\times10^{-27}\cdot\exp(65110\times Ti)$;

$\epsilon_i(0)$: Strain in a steel sheet in the ith stand of the hot finish rolling mill;

$t_i$: Time (second) from the ith stand to the final stand;

f: The total number of stands which constitute the hot finish rolling mill;

Ti: Rolling temperature (K) of a steel sheet in the ith stand.

(ii) The rolling reduction in the final stand of the hot finish rolling mill is 20% or more.

The grains in the (015)[100] orientation are produced in the grain boundaries of unrecrystallized ferrite grains, and the produced grains in the (015)[100] orientation have specific crystal orientation which newly appears regardless of the orientation of former ferrite grains. On the other hand, strain energy is introduced and accumulated in the crystal grain boundaries by hot rolling. When the accumulated strain energy is released due to recovery between the stands which constitute the hot rolling mill, the grain boundaries are curved to produce sub-grains by a bulging mechanism, and then recrystallization occurs. The recrystallized grains produced by bulging tend to inherit crystal orientation from former ferrite grains due to the production mechanism thereof. Therefore, in this process, the gains in the (015)[100] orientation cannot be produced.

Therefore, the inventors thought that by leaving ferrite grains unrecrystallized, and accumulating strain in the ferrite grain boundaries without releasing strain energy by recovery, the grains in the (015)[100] orientation can be produced by using the accumulated strain energy as driving force. As a result of many experiments, the inventors succeeded in deriving the formula 2 which represents the accumulated strain with consideration of release of strain energy by recovery between the stands during hot finish rolling, i.e., an amount of effective accumulated strain Q at the time of entrance into the final stand. As a result of further repeated experiment, the inventors found that by controlling the strain amount Q to 1.0 or more, recovery of grain boundaries at the time of entrance into the final stand is suppressed, and strain energy is accumulated, thereby significantly bearing grains in the (015)[100] orientation.

The above finding is described on the basis of the result of experiment. Steel slab containing 2.0 wt % of Si was subjected to hot rough rolling, and then the amount of effective accumulated strain Q determined by formula 2 and the rolling reduction at the final stand of the hot finish rolling mill were changed in hot finish rolling to obtain a hot-rolled sheet. The thus-obtained hot-rolled sheet was annealed to be recrystallized, and the ratio of intensity of the (015)[100] orientation to intensity of random orientation was measured.

FIG. 3 shows the results plotted at positions corresponding to the amounts of applied effective accumulated strains Q and the rolling reductions in the final stand of the hot finish rolling mill. In FIG. 3, a numeral represents the ratio of intensity in the (015)[100] orientation, and a symbols represent the degree of integration of grains in the (015)[100] orientation. In the figure, a high degree of integration is marked with o, a medium degree of integration is marked with Δ, and a low degree of integration is marked with x. FIG. 3 reveals that when the effective accumulated strain Q is 1.0 or more, and the rolling reduction at the final stand of the hot finish rolling mill is 20% or more, the ratio of intensity in the (015)[100] orientation is 3.0 or more. The reason why the rolling reduction in the final stand must be 20% or more is that this value is necessary for providing driving force for nucleation of grains in the (015)[100] orientation from grain boundaries where no bulging occurs. Where magnetic properties in the L direction and the C direction must be further improved, the rolling reduction is preferably 30% or more. As typical production conditions for attaining an amount of effective accumulated strain Q of 1.0 or more, for example, the hot rolling temperature is decreased, the residence time between the stands is shortened by high-speed hot rolling, etc.

The compositions, and optimum ranges of production conditions other than the above-described conditions will be described below.

C: 0.050 wt % or Less

C suppresses recrystallization between the passes through the hot finish rolling mill due to its segregation in crystal grain boundaries or the formation of a carbide. Namely, in the production method of the present invention, C is an element acting effectively in the maintenance of coarse grains before hot finish rolling, which is an essential matter. However, with a C content of over 0.050 wt %, domain wall motion in a product is suppressed, thereby deteriorating magnetic properties. Therefore, the upper limit of the C content is preferably 0.050 wt %.

Si: 4.0 wt % or Less

Si has the effect of increasing resistivity to decrease an eddy current loss, and is thus an essential additive element of the present invention. With a Si content of over 4.0%, the magnetic flux density is further decreased, and workability deteriorates. Therefore, the Si content is preferably 4.0 wt % or less. In order to increase the resistivity and further improve the texture, the Si content preferably exceeds 1.0 wt %. In some cases, with relation to the other production conditions for a magnetic steel sheet, the Si content of steel is limited by the rolling reduction and the strain rate of hot finish rolling in order to obtain a texture favorable for magnetic properties.

P: 0.35 wt % or Less

P has the effect of improving an iron loss, but with a P content of over 0.35 wt %, P possibly deteriorates workability, and thus causes hot rolling cracks or deterioration in stamping property. Therefore, the upper limit of the P content is preferably 0.35 wt %. With a P content of 0.02 wt % to 0.2 wt %, the volume fraction of ferrite recrystallized fine grains present in a steel structure immediately before hot finish rolling is decreased, thereby significantly improving magnetic properties. Therefore, the P content is more preferably 0.02 wt % to 0.2 wt %.

S: 0.050 wt % or Less

S forms MnS and suppresses recrystallization between the passes of hot finish rolling. Therefore, S effectively acts on the maintenance of coarse grains before hot finish rolling, which is an essential specified matter of the production method of the present invention. However, with a S content of over 0.050 wt %, there is the tendency to deteriorate magnetic properties by suppressing the domain wall motion in a product. Therefore the upper limit of the S content is preferably 0.050 wt %.

Al: 2.0 wt % or Less, Mn: 2.0 wt % or Less

Both Al and Mn are deoxidizers for steel making process, and have the effect of increasing resistivity to decrease an eddy current loss. However, where each of the Al and Mn contents exceeds 2.0 wt %, the magnetic flux density and workability significantly deteriorate. Therefore, both the Al and Mn contents are preferably in the range of 2.0 wt % or less.

Cr: 10.0 wt % or Less

Cr has the effect of increasing resistivity to decrease an eddy current loss. However, with a Cr content of over 10.0 wt %, the magnetic flux density and workability significantly deteriorate. Therefore, the Cr content is preferably in the range of 10.0 wt % or less.

Mo: 2.0 wt % or Less, W: 2.0 wt % or Less, Cu: 2.0 wt % or Less

Mo, W and Cu have the effect of increasing resistivity to decrease an eddy current loss. However, with each of these contents of over 2.0 wt %, the magnetic flux density and workability significantly deteriorate. Therefore, each of the Mo, W and Cu contents is preferably in the range of 2.0 wt % or less.

Ni: 2.0 wt % or Less

Ni has the effect of increasing resistivity to decrease an eddy current loss. However, with a Ni content of over 2.0 wt %, the magnetic flux density significantly deteriorates. Therefore, the Ni content is preferably in the range of 2.0 wt % or less.

Co: 1.0 wt % or Less

Co has the effect of increasing resistivity to decrease an eddy current loss. However, with a Co content of over 1.0 wt %, the magnetic flux density significantly deteriorates, and cost is increased. Therefore, the Co content is preferably in the range of 1.0 wt % or less.

When it is necessary to further suppress the production of fine grains, at least one of 0.20 wt % or less of Ti, 0.20 wt % or less of V, 0.20 wt % or less of Nb, 0.20 wt % or less of Zr, 0.50 wt % or less of Ta, 0.20 wt % or less of As, 0.20 wt % or less of Sb, 0.20 wt % or less of Sn, 0.010 wt % or less of B, 0.010 wt % or less of N, and 0.010 wt % or less of 0 is preferably further contained. Ti: 0.20 wt % or less, V: 0.20 wt % or less, Nb: 0.20 wt % or less, Zr: 0.20 wt % or less, Ta: 0.50 wt % or less Any of Ti, V, Nb, Zr and Ta combines with C and N to precipitate as a fine carbonitride. Such precipitates suppress recrystallization between passes of hot finish rolling, and thus have the effective action on the maintenance of coarse grains before hot finish rolling, which is an essential matter to define the invention in the production method of the present invention. However, with each of Ti, V, Nb and Zr contents of over 0.20 wt %, or a Ta content of over 0.50 wt %, domain wall motion in a product is suppressed, and magnetic properties deteriorate. Therefore, the upper limit of each of the Ti, V, Nb and Zr contents is preferably 0.20 wt %, and the upper limit of the Ta content is preferably 0.50 wt %. As: 0.20 wt % or less, Sb: 0.20 wt % or less, Sn: 0.20 wt % or less Any of As, Sb and Sn segregates in crystal grain boundaries to suppress recrystalliztion between the passes of hot finish rolling, and thus acts effectively in the maintenance of coarse grains before hot finish rolling, which is an essential matter to define the invention in the production method of the present invention. However, with each of As, Sb and Sn contents of over 0.20 wt %, domain wall motion in a product is suppressed, and magnetic properties deteriorate. Therefore, the upper limit of each of the As, Sb and Sn contents is preferably 0.20 wt %.

B: 0.010 wt % or Less

B segregates in crystal grain boundaries or forms a nitride to precipitate in steel, suppressing recrystallization between the passes of hot finish rolling. Thus B acts effectively in the maintenance of coarse grains before hot finish rolling, which is an essential matter to define the invention in the production method of the present invention. However, with a B content of over 0.010 wt %, domain wall motion in a product is suppressed, and magnetic properties deteriorate. Therefore, the upper limit of the B content is preferably 0.010 wt %.

N: 0.010 wt % or Less

N forms a nitride to suppress recrystallization between the passes of hot finish rolling. Thus N acts effectively in the maintenance of coarse grains before hot finish rolling, which is an essential matter to define the invention in the production method of the present invention. However, with a N content of over 0.010 wt %, domain wall motion in a product is suppressed, and magnetic properties deteriorate. Therefore, the upper limit of the N content is preferably 0.010 wt %.

0: 0.010 wt % or Less

O forms an oxide to suppress recrystallization between the passes of hot finish rolling. Thus O acts effectively in the maintenance of coarse grains before hot finish rolling, which is an essential matter to define the invention in the production method of the present invention. However, with an O content of over 0.010 wt %, domain wall motion in a product is suppressed, and magnetic properties deteriorate. Therefore, the upper limit of the N content is preferably 0.010 wt %.

The magnetic steel sheet of the present invention preferably comprises steel structure composed of a ferrite single phase even in the heating region before hot rolling, i.e., steel having a composition causing no phase transformation.

With small contents of ferrite forming elements, the austenite phase is produced at high temperature, and ferrite transformation takes place before hot finish rolling, thereby promoting micronization of crystal grains. Namely, it is difficult to produce coarse grains having an average ferrite grain size of 200 $\mu$m or more before hot finish rolling, thereby improving magnetic properties cannot be sufficiently obtained. Therefore, non-transformation steel is preferable in the course of hot rolling.

As a composition condition for obtaining non-transformation steel, it is necessary to satisfy Formula 3.

$$f=(1.5[Si]+2[P]+2.5[Al]+[Cr]+[Mo]+[W])-(30[C]+30[N]+0.5[Mn]+0.5[Cu]+[Ni])\geqq 2.5 \quad \text{Formula 3}$$

wherein f represents the non-transformation index, and [ ] represents wt %.

Besides the above-described production conditions, the production conditions below are more preferably limited.

(i) Slab Heating Temperature: in the Range of 1100 to 1500° C.

As the slab heating temperature increases, crystal grains are more coarsened during heating. The crystal grains before hot finish rolling are readily coarsened with coarsening of the slab crystal grains. Therefore, in order to improve magnetic properties, it is effective to increase the slab heating temperature. In order to obtain the sufficient effect, the slab heating temperature is preferably 1100° C. or more. However, excessively high temperature causes the problem of deteriorating yield due to an increase in scaling, and the upper limit of the slab heating temperature is preferably 1500° C.

(ii) Heating or Warmth Keeping Before Hot Finish Rolling: in the Temperature Range of 1000° C. to 1150° C.

In the present invention, it is necessary to obtain coarse grains before hot finish rolling. Therefore, a steel sheet is preferably heated or kept warm at a temperature of 1000° C. to 1500° C. to coarse crystal grains until it enters the hot finish rolling mill after hot rough rolling. Although the steel bearing the austenite phase during heating causes ferrite transformation in subsequent cooling, the initial austenite grains have a large grain size, and are thus effective for coarsening the ferrite grains at the time of entrance in the finish rolling mill. Heating or warmth keeping is thus preferred for such steel.

(iii) Rolling Reduction in Cold Rolling: 50 to 85%

In cold rolling the structure formed by hot rolling, an excessively high rolling reduction of cold rolling has the tendency to increase grains in the <111>//ND orientation. Therefore, the upper limit of the rolling reduction in cold rolling is preferably 85%. With an excessively low rolling reduction in cold rolling, the amount of grains in the regular cube orientation is decreased, and thus the rolling reduction in cold rolling is preferably 50% or more.

In the present invention, even when a steel sheet is subjected to the cold rolling step immediately after hot rolling, the iron loss property can be significantly improved as compared with a conventional production process using a material having the same composition. However, when the hot-rolled sheet is annealed after hot rolling, the iron loss property is more significantly improved, and the magnetic flux density is also improved.

The above description concerns only an embodiment of the present invention, and various changes can be made in the scope of the claims of the present invention. For example, in the present invention, besides the above production condition, 2 to 10% skin pass rolling may be performed to the product sheet to obtain a semi-processed material, followed by strain removing annealing. Further improvement of the magnetic flux density and the iron loss can be expected from this treatment.

BRIEF DESCRIPTION OF THE DRAWINGS

FIG. 1 is a graph of the iron loss and the magnetic flux density averaged in the LC directions shown in Table 3.

FIG. 2 is a graph showing the relation between the Si content and the ratio Z/R of the thickness reduction strain rate Z to the rolling reduction R in each rolling stand of a hot finish rolling mill.

FIG. 3 is a graph in which the results of measurement of the ratio of intensity in the (015)[100] orientation to random intensity of the steel sheet are shown with respect to the change of the-effective accumulated strain R and the rolling reduction in a final stand of hot finish rolling mill.

BEST MODE FOR CARRYING OUT THE INVENTION

EXAMPLE 1

Figure 1:
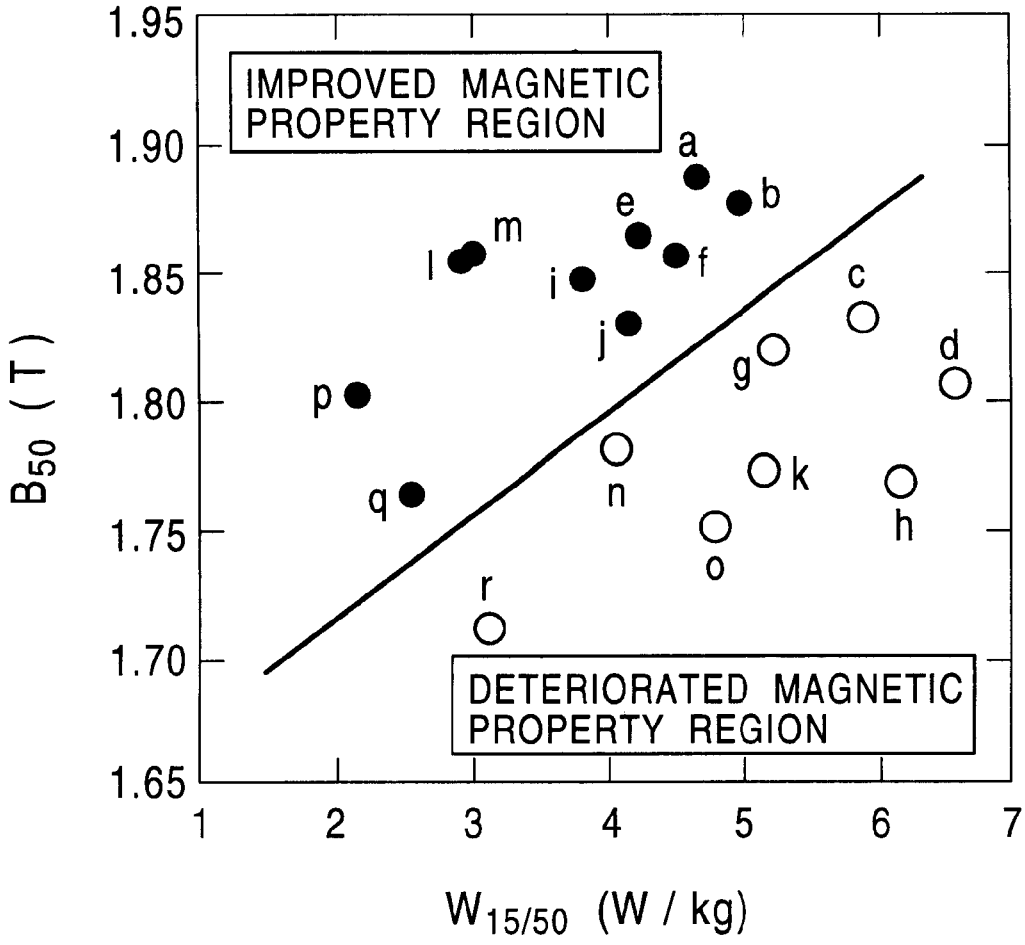
[FIG. 1]
Figure 2:
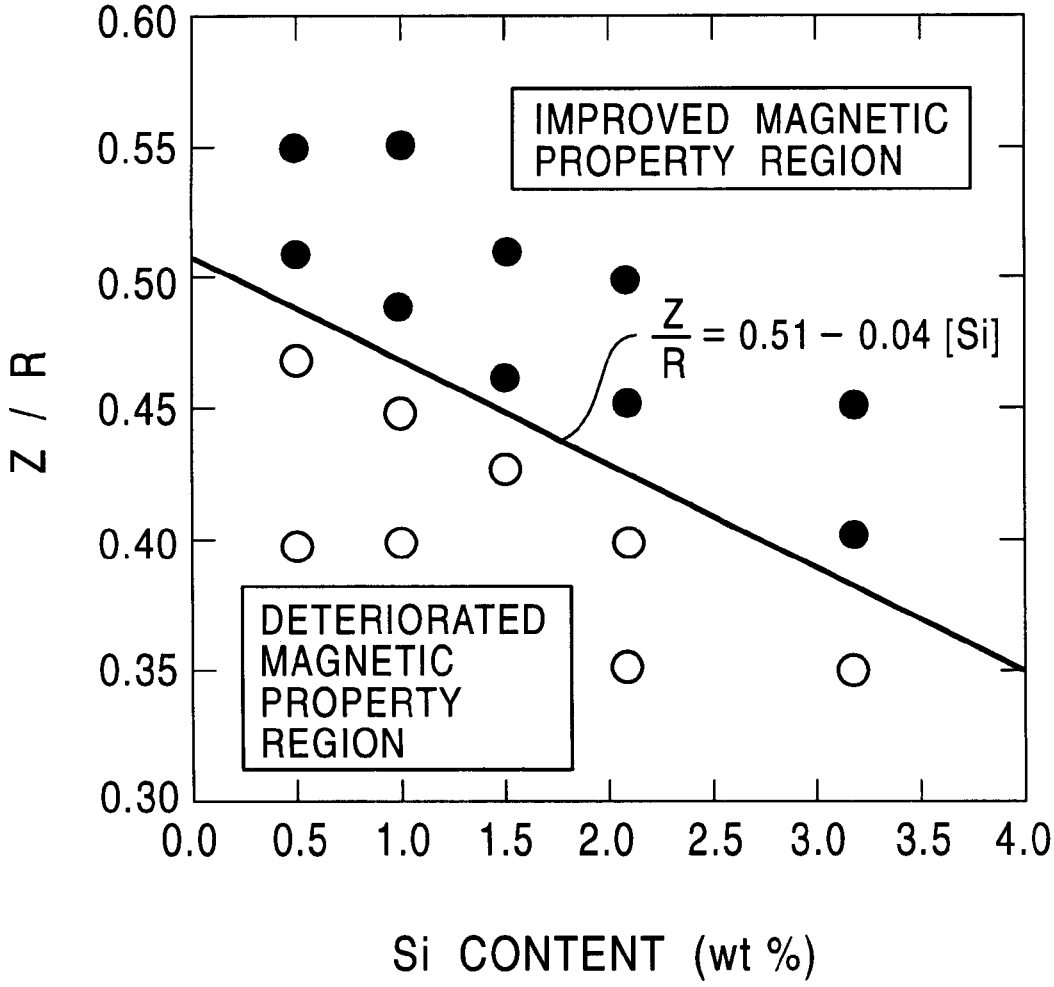
[FIG. 2]
Figure 3:
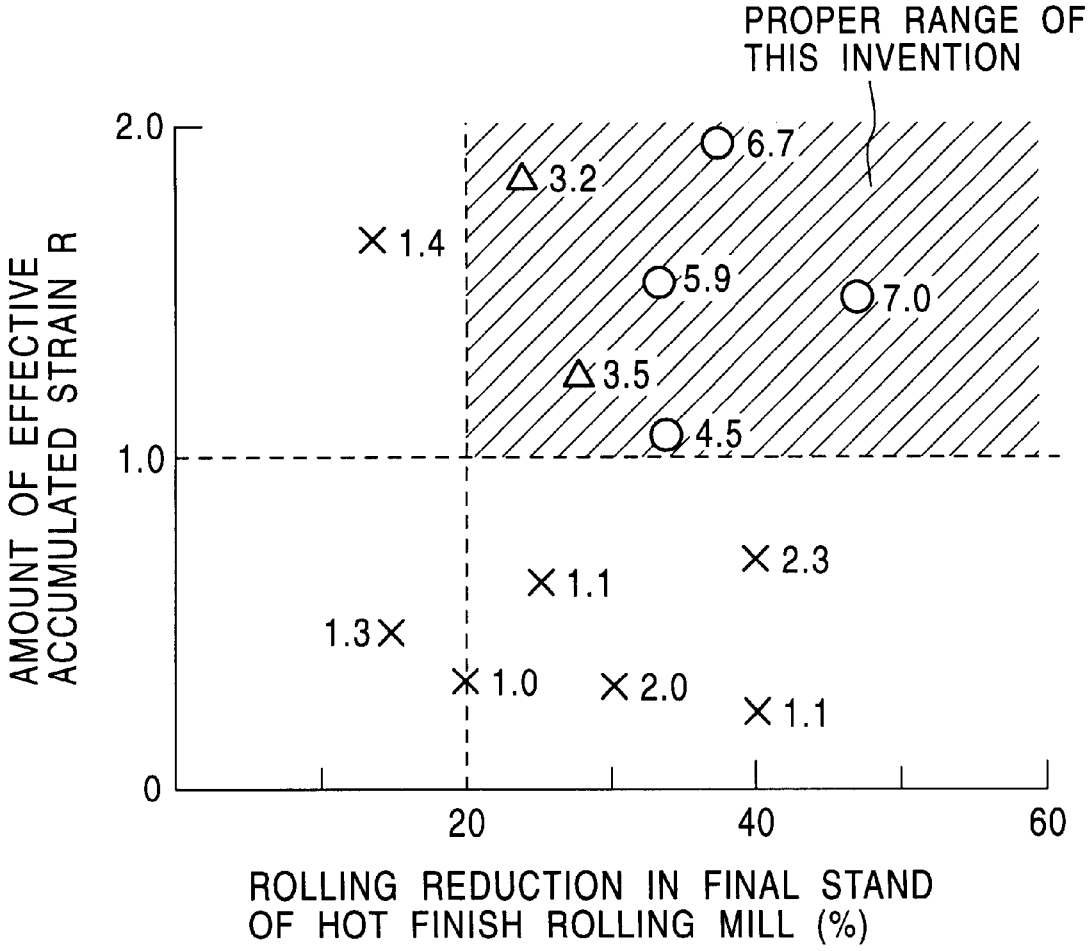
[FIG. 3]

Each of the steel types shown in Tables 4 and 5 was melted by a converter to obtain slab having a thickness of 200 mm by continuous casting. Slab Nos. 1 to 5 contain 4 wt % or less of Si, and have a basic composition. Slab No. 6 has a Si content beyond the optimum range of the present invention. Slab Nos. 7 to 9 have compositions to which a second element is added for increasing electric resistance to improve an iron loss value. Slab Nos. 14 to 17 contain at least one of the second elements added in an amount beyond the optimum range of the present invention. Slab Nos. 18 and 19 are samples used for examining the influence of nontransformation index f. Slab Nos. 20 to 29 have compositions containing an element added for aggregating grain boundaries or forming precipitates. Slab Nos. 21, 25 and 28 are comparative examples to Slab Nos. 20, 24 and 27, respectively, which contain these elements for aggregating grain boundaries or forming precipitates beyond the optimum range of the present invention. Table 5 also shows the nontransformation index f.

Next, each of the slab samples was heated again, and then subjected to hot rough rolling and then hot finish rolling. Table 6 shows the slab heating conditions, conditions before hot finish rolling, hot finish rolling conditions and cold rolling conditions. The sheet thickness after hot rough rolling and hot finish rolling was set so that the thickness of a cold rolled sheet was 0.50 mm. After hot finish rolling, normalizing annealing was carried out in the ferrite single phase region of 850 to 1000° C. according to the slab composition. After cold rolling, finish annealing was performed at 850 to 1000° C. Table 6 shows the production conditions, as well as the $A_{r1}$ transformation temperature (° C.) of steel having a composition causing the austenite phase, the volume fraction (%) of equiaxed ferrite immediately before hot finish rolling, the average ferrite grain size ($\mu$m), the volume fraction of grains of 100 $\mu$m or less, and the ratio of integrated intensity in the (015)[100] orientation before cold rolling. Table 7 shows the average integrated intensity ratios in the {100}<001> orientation, in the {0111}<100> orientation and in the <111>//ND orientation, and magnetic properties.

Description will now be made of the effect of improving the magnetic properties in the present invention on the basis of Tables 6 and 7. The present invention contains a resistivity increasing element for improving an iron loss. Therefore, the effects of the present invention shown in Tables 6 and 7 were evaluated overall from the balance between the iron loss and magnetic flux density.

Comparison of steel Nos. 1 to 5 of the present invention reveals that with a Si amount in the proper range of the present invention, a good texture and magnetic properties can be obtained. Comparison between steel Nos. 1 and 2 of the present invention having a Si content of 1 wt % or less, and steel Nos. 3 to 5 of the present invention having a Si content of over 1 wt % indicates that the effect of the present invention is further exhibited with a Si content of over 1 wt %. In comparative steel No. 6 having a Si content (4.2 wt %) beyond the proper range of the present invention, magnetic properties deteriorate, and the desired effect of the present invention cannot be obtained.

Steel Nos. 7 and 8 or Steel Nos. 24 and 25 were produced by a conventional production method and the production method of the present invention using slab having the same composition. Comparison of these steel types reveals that a steel sheet produced by the method of the present invention has excellent magnetic properties as compared with a steel sheet produced by a conventional method.

Comparison between steel No. 8 of the present invention and steel Nos. 21 to 24, 26 and 27 of the present invention indicates that even when a second element such as Al, Mn, or the like is added, an excellent texture and magnetic properties can be obtained.

Comparison between steel Nos. 8, 21 to 24, 26 and 27 of the present invention and Comparative steel Nos. 28 to 31 reveals that when the content of the second element such as Al, Mn, or the like for improving the ion loss is beyond the optimum range of the present invention, the texture and magnetic properties deteriorate, and thus the effect of the present invention is not exhibited.

Like steel No. 8, Steel Nos. 34, 36 to 38, 40, 41 and 43 of the present invention containing the aggregation or precipitation element in the optimum range of the present invention exhibit excellent magnetic properties.

On the other hand, comparison between steel Nos. 8, 34, 36 to 38, 40, 41 and 43 of the present invention and steel Nos. 35, 39 and 42 of the present invention containing the aggregation or precipitation element beyond the optimum range of the present invention indicates that the magnetic properties of steel Nos. 35, 39 and 42 are less improved as compared with steel Nos. 8, 34, 36 to 38, 40, 41 and 43.

Comparison of steel Nos. 1 to 5 of the present invention, and comparison between steel No. 8 of the present invention and steel Nos. 32 and 33 of the present invention reveal that non-transformation steel causing no transformation to austenite at high temperatures significantly exhibits the effect of the present invention.

Comparison between steel Nos. 8 and 10 of the present invention indicates that with a slab heating temperature lower than the optimum range of the present invention, the grain size before hot finish rolling is decreased, thereby decreasing the effect of the present invention.

Comparison between steel Nos. 8 and 11 of the present invention reveals that by using the heating or heat insulation step before hot finish rolling, crystal grains before hot rolling is coarsened even with a low slab heating temperature, thereby sufficiently exhibiting the effect of the present invention.

Comparison between steel No. 8 of the present invention, and Comparative steel Nos. 12 and 13 in which the hot finish rolling temperature is higher than the proper range of the present invention indicates that Comparative steel Nos. 12 and 13 do not exhibit the effect of the present invention because the coarsening effect disappears due to recrystallization between passes in hot finish rolling.

In Comparative steel Nos. 15 and 16, the conditions of hot rough rolling were changed so that the grain size before hot finish rolling was beyond the proper range of the present invention. Comparison to steel No. 8 of the present invention indicates that when ferrite grains before hot rolling do not satisfy the conditions of the present invention, the effect of the present invention is not exhibited.

Comparison between steel Nos. 8, 9 and 11 of the present invention, and steel Nos. 10 and 14 of the present invention in which the grain size before hot finish rolling is beyond the optimum range (650 $\mu$m or more) of the present invention indicates that in steel Nos. 10 and 14, the effect of the present invention is decreased.

Comparison between steel No. 8 of the present invention and Comparative steel Nos. 17 and 18 having a Z/R ratio beyond the range of the present invention reveals that in steel Nos. 17 and 18, the texture deteriorates, and thus the effect of the present invention is not exhibited.

The above-described results show that only when all requirements of the production of the present invention are satisfied, excellent magnetic properties can be obtained.

Comparison between steel No. 8 of the present invention, and steel Nos. 19 and 20 of the present invention in which the rolling reduction of cold rolling is beyond the optimum range of the present invention reveals that in steel Nos. 19 and 20, the texture deteriorates, and thus the effect of the present invention is decreased.

EXAMPLE 2

Each of the steel types shown in Table 8 was melted by a converter to obtain slab having a thickness of 200 mm by continuous casting. The thus-obtained slab was again heated to 1200° C., subjected to hot rough rolling to form a sheet bar having a thickness of 40 mm, followed by hot finish rolling. Table 9 shows the conditions of hot finish rolling and the grain sizes immediately before hot finish rolling. The thickness after hot finish rolling was 2.3 mm. After hot finish rolling, recrystallization treatment was performed at 850 to 1000° C. Then, cold rolling was carried out to obtain a sheet having a thickness of 0.50 mm, followed by finish annealing at 850 to 1000° C. to produce a magnetic steel sheet (steel Nos. 1 to 21). Table 9 also shows the production conditions, and the texture and magnetic properties after finish annealing.

Description will now be made of the magnetic property improving effect of the present invention on the basis of Table 9. The present invention contains a resistivity increasing component for improving the iron loss. Therefore, the magnetic properties shown in Table 9 were evaluated overall from the results of both the iron loss and magnetic flux density.

In comparison between steel Nos. 1, 5 and 6, 11, and 15 and 16 produced according to the present invention, and steel Nos. 2 to 4, 7 to 10, 12 to 14, and 17 to 19 using the same steel slab types as steel Nos. 1, 5 and 6, 11, and 15 and 16, respectively, in which at least one of the production conditions of the present invention is beyond the proper range of the present invention, steel Nos. 1, 5 and 6, 11, and 15 and 16 exhibit excellent magnetic properties, as compared with steel Nos. 2 to 4, 7 to 10, 12 to 14, and 17 to 19.

Steel No. 20 produced according to the present invention except that the Si content is beyond the proper range of the present invention exhibits no significant difference in magnetic properties from steel No. 21 beyond the proper range of the present invention.

It is also found that in steel Nos. 5 and 15 produced with a rolling reduction of the first stand of the hot finish rolling mill in the optimum range of the present invention, magnetic properties are further improved, as compared with steel Nos. 6 and 16 produced under conditions in the proper range of the present invention beyond the optimum range thereof. Table 9 shows that when the ratio of integrated intensity of (015)[100] after hot rolling and recrystallization to the random structure is 3.0 or more, when the ratio of integrated intensity of the regular cube orientation after finish annealing is 2.0 or more, when the ratio of integrated intensity of the Goss orientation after finish annealing is 2.0 to 10.0, and when the ratio of integrated intensity of the <111>//ND orientation after finish annealing is 2.0 or less, good magnetic properties are exhibited.

Therefore, in the present invention, it is more preferable that the ratio of integrated intensity of (015)[100] after hot rolling and recrystallization to the random structure is 3.0 or more, the ratio of integrated intensity of the regular cube orientation after finish annealing is 2.0 or more, the ratio of integrated intensity of the Goss orientation after finish annealing is 2.0 to 10.0, and the ratio of integrated intensity of the <111>//ND orientation after finish annealing is 2.0 or less.

EXAMPLE 3

Each of the steel types shown in Table 10 was melted by a converter to obtain slab having a thickness of 200 mm by continuous casting. The thus-obtained slab was again heated to 1200° C., and subjected to hot rough rolling and then hot finish rolling. Table 11 shows the conditions of hot finish rolling and the interlayer spacing of unrecrystallized elongated ferrite grains after hot finish rolling. The thickness after hot finish rolling was 2.3 mm. The interlayer spacing and the total rolling reduction were adjusted by controlling hot rough rolling conditions and the thickness of a sheet after hot rough rolling.

After hot finish rolling, recrystallization treatment was performed at 850 to 1000° C. Then, cold rolling was carried out to obtain a sheet having a thickness of 0.50 mm, followed by finish annealing at 850 to 1000° C. to produce a magnetic steel sheet (steel Nos. 1 to 17). Table 11 also shows the production conditions, and the texture and magnetic properties after finish annealing.

Description will now be made of the magnetic property improving effect of the present invention on the basis of Table 11. The present invention contains a resistivity increasing component for improving the iron loss. Therefore, the magnetic properties shown in Table 2 were evaluated overall from the results of both the iron loss and magnetic flux density.

From comparison between steel Nos. 1, 5, 9 and 14 produced according to the present invention, and steel Nos. 2 to 4, 6 to 8, 10 to 13, and 15 produced under conditions in which at lest one of the production conditions of the present invention is beyond the proper range, steel Nos. 1, 5, 9 and 14 exhibit excellent magnetic properties as compared with steel Nos. 2 to 4, 6 to 8, 10 to 13, and 15.

Steel No. 16 produced according to the present invention except that the Si content is beyond the proper range of the present invention exhibit no significant difference in magnetic properties from steel No. 17 produced under the conditions beyond the proper range of the present invention.

Table 2 shows that when the ratio of integrated intensity of (015)[100] after hot rolling and recrystallization to the random structure is 3.0 or more, when the ratio of integrated intensity of the regular cube orientation after finish annealing is 2.0 or more, when the ratio of integrated intensity of the Goss orientation after finish annealing is 2.0 to 10.0, and when the ratio of integrated intensity of the <111>//ND orientation after finish annealing is 2.0 or less, good magnetic properties are exhibited.

Therefore, in the present invention, it is more preferable that the ratio of integrated intensity of (015)[100] after hot rolling and recrystallization to the random structure is 3.0 or more, the ratio of integrated intensity of the regular cube orientation after finish annealing is 2.0 or more, the ratio of integrated intensity of the Goss orientation after finish annealing is 2.0 to 10.0, and the ratio of integrated intensity of the <111>//ND orientation after finish annealing is 2.0 or less.

EXAMPLE 4

Each of the steel types shown in Table 12 was melted by a converter to obtain steel slab having a thickness of 200 mm by continuous casting. The thus-obtained steel slab was again heated to 1200° C., and subjected to hot rough rolling to form a sheet bar having a thickness of 40 mm, followed by hot finish rolling. Table 13 shows the conditions of hot finish rolling. The thickness after hot finish rolling was 2.3 mm. After hot finish rolling, recrystallization treatment was performed at 850 to 1000° C. Then, cold rolling was carried out to obtain a sheet having a thickness of 0.50 mm, followed by finish annealing at 850 to 1000° C. to produce a magnetic steel sheet (steel Nos. 1 to 27).

Table 13 also shows the production conditions, and the texture and magnetic properties.

The texture was measured by a method comprising determining (110), (200) and (211) pole figures by a Schultz X-ray diffraction method, and then calculating three-dimensional orientation distribution densities.

Description will now be made of the magnetic property improving effect of the present invention on the basis of Table 13. The present invention contains a resistivity increasing component for improving the iron loss. Therefore, the magnetic properties shown in Table 13 were evaluated overall from the results of both the iron loss and magnetic flux density.

In comparison between steel Nos. 1 to 3, 7 to 10, 14 to 17, and 22 to 24 produced according to the present invention, and steel Nos. 4 to 6, 11 to 13, 18 to 21, and 25 to 27 produced under conditions in which at lest one of the production conditions of the present invention is beyond the proper range, steel Nos. 1 to 3, 7 to 10, 14 to 17, and 22 to 24 exhibit significantly excellent magnetic properties as compared with steel Nos. 4 to 6, 11 to 13, 18 to 21, and 25 to 27.

Table 13 shows that when the ratio of integrated intensity of (015)[100] after hot rolling and recrystallization to the random structure is 3.0 or more, when the ratio of integrated intensity of the regular cube orientation after finish annealing is 2.0 or more, when the ratio of integrated intensity of the Goss orientation after finish annealing is 2.0 to 10.0, and when the ratio of integrated intensity of the <111>//ND orientation after finish annealing is 2.0 or less, good magnetic properties are exhibited.

Therefore, in the present invention, it is more preferable that the ratio of integrated intensity of (015)[100] after hot rolling and recrystallization to the random structure is 3.0 or more, the ratio of integrated intensity of the regular cube orientation after finish annealing is 2.0 or more, the ratio of integrated intensity of the Goss orientation after finish annealing is 2.0 to 10.0, and the ratio of integrated intensity of the <111>//ND orientation after finish annealing is 2.0 or less.

INDUSTRIAL APPLICABILITY

With a magnetic steel sheet of the present invention, significantly excellent magnetic properties can be realized by optimizing the steel composition and texture, as compared with conventional magnetic steel sheets.

The method of producing a magnetic steel sheet of the present invention can industrially produce, at low cost, a magnetic steel sheet having high magnetic flux density and excellent magnetic properties in both the L direction and the C direction, which cannot be readily realized by a conventional production method, without special cold rolling and annealing steps.

TABLE 1

| | Texture | | | Magnetic properties | | | | | | |
|---|---|---|---|---|---|---|---|---|---|---|
| | Regular Cube | Goss (011) | <111> | Magnetic flux density $B_{50}$ (T) | | | Iron loss $W_{15/50}$ (W/kg) | | | |
| Steel type | (100) (001) Ratio to random structure (times) | [100] | //ND | L | C | LC average | L | C | LC average | |
| A | 0.9 | 1.7 | 2.5 | 1.783 | 1.700 | 1.741 | 3.41 | 3.72 | 3.56 | Comp. |
| B | 0.9 | 1.7 | 3.0 | 1.770 | 1.695 | 1.732 | 3.70 | 4.03 | 3.87 | steel |
| C | 1.2 | 1.4 | 2.3 | 1.778 | 1.689 | 1.733 | 3.54 | 3.88 | 3.71 | |
| D | 1.7 | 1.6 | 2.3 | 1.781 | 1.692 | 1.736 | 3.51 | 3.86 | 3.68 | |
| E | 2.4 | 1.6 | 2.2 | 1.780 | 1.707 | 1.744 | 3.42 | 3.71 | 3.57 | |
| F | 1.7 | 2.4 | 2.1 | 1.790 | 1.702 | 1.746 | 3.30 | 3.61 | 3.45 | |
| G | 2.4 | 2.4 | 2.1 | 1.831 | 1.757 | 1.794 | 3.14 | 3.46 | 3.30 | Steel |
| H | 2.4 | 2.4 | 1.6 | 1.830 | 1.765 | 1.798 | 2.95 | 3.28 | 3.12 | of this |
| I | 2.4 | 2.4 | 1.3 | 1.834 | 1.766 | 1.800 | 2.84 | 3.15 | 3.00 | inven- |
| J | 2.4 | 2.4 | 0.7 | 1.839 | 1.764 | 1.801 | 2.62 | 2.94 | 2.78 | tion |
| K | 2.5 | 15.0 | 1.3 | 1.885 | 1.620 | 1.753 | 2.17 | 4.70 | 3.44 | Comp. |
| L | 2.6 | 7.4 | 1.2 | 1.845 | 1.760 | 1.803 | 2.53 | 2.87 | 2.70 | Steel |
| M | 2.5 | 2.8 | 1.1 | 1.840 | 1.762 | 1.801 | 2.74 | 3.06 | 2.90 | of this |
| N | 3.8 | 3.1 | 0.7 | 1.855 | 1.772 | 1.814 | 2.44 | 2.76 | 2.60 | inven- |
| O | 8.0 | 3.2 | 0.7 | 1.871 | 1.795 | 1.833 | 2.28 | 2.58 | 2.43 | tion |
| P | 12.0 | 2.8 | 0.6 | 1.880 | 1.794 | 1.837 | 2.05 | 2.37 | 2.21 | |
| Q | 18.0 | 2.7 | 0.6 | 1.891 | 1.816 | 1.854 | 1.73 | 2.05 | 1.89 | |

TABLE 2-1

| Steel | Chemical composition (wt %) | | | | | | | | *Volume frac- | Total rolling reduction in hot final | Hot finish rolling temper- | $A_{r1}$ trans- formation tempera- | Re- |
|---|---|---|---|---|---|---|---|---|---|---|---|---|---|
| No. | C | Si | Mn | P | S | Al | N | O | tion (%) | rolling (%) | ature (° C.) | ture (° C.) | marks |
| 1 | 0.003 | 1.17 | 0.18 | 0.010 | 0.005 | 0.23 | 0.0034 | 0.0021 | 0 | 98 | 921 | 956 | A |
| 2 | 0.003 | 1.17 | 0.18 | 0.010 | 0.005 | 0.23 | 0.0034 | 0.0021 | 0 | 98 | 705 | 956 | A |
| 3 | 0.003 | 1.17 | 0.18 | 0.010 | 0.005 | 0.23 | 0.0034 | 0.0021 | 0 | 96 | 815 | 956 | A |
| 4 | 0.003 | 1.17 | 0.18 | 0.010 | 0.005 | 0.23 | 0.0034 | 0.0021 | 0 | 75 | 885 | 956 | A |

TABLE 2-1-continued

| Steel No. | Chemical composition (wt %) C | Si | Mn | P | S | Al | N | O | *Volume fraction (%) | Total rolling reduction in hot final rolling (%) | Hot finish rolling temperature (° C.) | $A_{r1}$ transformation temperature (° C.) | Remarks |
|---|---|---|---|---|---|---|---|---|---|---|---|---|---|
| 5 | 0.003 | 1.17 | 0.18 | 0.010 | 0.005 | 0.23 | 0.0034 | 0.0021 | 0 | 27 | 895 | 956 | B |
| 6 | 0.003 | 1.17 | 0.18 | 0.010 | 0.005 | 0.23 | 0.0034 | 0.0021 | 1 | 94 | 875 | 956 | A |
| 7 | 0.003 | 1.17 | 0.18 | 0.010 | 0.005 | 0.23 | 0.6034 | 0.0021 | 2 | 93 | 864 | 956 | A |
| 8 | 0.003 | 1.17 | 0.18 | 0.010 | 0.005 | 0.23 | 0.0034 | 0.0021 | 2 | 98 | 871 | 956 | A |
| 9 | 0.003 | 1.17 | 0.18 | 0.010 | 0.005 | 0.23 | 0.0034 | 0.0021 | 24 | 97 | 883 | 956 | B |
| 10 | 0.003 | 1.17 | 0.18 | 0.010 | 0.005 | 0.23 | 0.0034 | 0.0021 | 40 | 97 | 735 | 956 | B |
| 11 | 0.003 | 1.17 | 0.18 | 0.010 | 0.005 | 0.23 | 0.0034 | 0.0021 | 0 | 97 | 1012 | 956 | B |
| 12 | 0.005 | 0.82 | 0.21 | 0.005 | 0.003 | 0.21 | 0.0048 | 0.0042 | 0 | 97 | 742 | 893 | B |
| 13 | 0.005 | 0.82 | 0.21 | 0.005 | 0.003 | 0.21 | 0.0048 | 0.0042 | 35 | 97 | 728 | 893 | B |
| 14 | 0.002 | 1.65 | 0.23 | 0.005 | 0.002 | 0.18 | 0.0021 | 0.0025 | 0 | 97 | 892 | 1137 | A |
| 15 | 0.002 | 1.65 | 0.23 | 0.005 | 0.002 | 0.18 | 0.0021 | 0.0025 | 23 | 97 | 873 | 1137 | B |
| 16 | 0.003 | 1.85 | 0.18 | 0.008 | 0.004 | 0.23 | 0.0025 | 0.0028 | 0 | 97 | 1025 | No | A |
| 17 | 0.003 | 1.85 | 0.18 | 0.008 | 0.004 | 0.23 | 0.0025 | 0.0028 | 0 | 25 | 1016 | No | B |
| 18 | 0.003 | 2.10 | 0.21 | 0.010 | 0.003 | 0.01 | 0.0031 | 0.0023 | 0 | 97 | 1075 | No | A |
| 19 | 0.003 | 3.20 | 0.16 | 0.005 | 0.004 | 0.01 | 0.0034 | 0.0021 | 0 | 97 | 1068 | No | A |
| 20 | 0.003 | 3.40 | 0.15 | 0.003 | 0.002 | 0.01 | 0.0018 | 0.0019 | 0 | 97 | 965 | No | A |
| 21 | 0.005 | 1.45 | 0.02 | 0.010 | 0.002 | 0.03 | 0.0015 | 0.0018 | 2 | 97 | 935 | 1020 | A |
| 22 | 0.002 | 1.45 | 0.02 | 0.010 | 0.002 | 0.03 | 0.0015 | 0.0018 | 1 | 97 | 928 | 1020 | A |
| 23 | 0.005 | 1.45 | 0.02 | 0.130 | 0.002 | 0.03 | 0.0015 | 0.0018 | 0 | 97 | 932 | 1020 | A |
| 24 | 0.002 | 1.45 | 0.02 | 0.120 | 0.002 | 0.03 | 0.0015 | 0.0018 | 0 | 97 | 930 | 1020 | A |

*Volume fraction = Volume fraction of recrystallized ferrite grains having a grain size of 100 μm or less immediately before finish rolling
A: Example of this invention, B: Comparative Example

TABLE 2-2

| Steel No. | Texture: After hot rolling and recrystallization, Ratio to random structure: (015) [100] | After cold rolling and annealing, Ratio to random structure: Regular Cube (100) [001] | Goss (011) [100] | <111> //ND | Magnetic Properties: Magnetic flux density $B_{50}$ (T) L | C | LC average | Iron loss $W_{15/50}$ (W/kg) L | C | LC average |
|---|---|---|---|---|---|---|---|---|---|---|
| 1 | 3.3 | 2.3 | 2.5 | 1.8 | 1.845 | 1.766 | 1.806 | 4.13 | 4.54 | 4.34 |
| 2 | 3.5 | 2.2 | 2.2 | 1.7 | 1.846 | 1.762 | 1.804 | 4.11 | 4.55 | 4.33 |
| 3 | 3.3 | 2.4 | 2.3 | 1.6 | 1.850 | 1.766 | 1.808 | 4.04 | 4.45 | 4.25 |
| 4 | 3.4 | 2.3 | 2.5 | 1.7 | 1.848 | 1.773 | 1.810 | 4.08 | 4.52 | 4.30 |
| 5 | 1.5 | 0.7 | 1.2 | 3.6 | 1.786 | 1.696 | 1.741 | 5.26 | 5.81 | 5.53 |
| 6 | 3.4 | 2.2 | 2.6 | 1.7 | 1.848 | 1.770 | 1.809 | 4.08 | 4.50 | 4.29 |
| 7 | 3.5 | 2.3 | 2.4 | 1.5. | 1.852 | 1.767 | 1.810 | 3.99 | 4.42 | 4.20 |
| 8 | 3.3 | 2.4 | 2.5 | 1.7 | 1.848 | 1.766 | 1.807 | 4.07 | 4.45 | 4.26 |
| 9 | 1.5 | 1.2 | 1.3 | 3.8 | 1.784 | 1.712 | 1.748 | 5.32 | 5.80 | 5.56 |
| 10 | 0.8 | 1.0 | 0.9 | 3.5 | 1.788 | 1.718 | 1.753 | 5.21 | 5.72 | 5.46 |
| 11 | 1.2 | 1.2 | 1.2 | 4.0 | 1.778 | 1.706 | 1.742 | 5.43 | 5.94 | 5.68 |
| 12 | 1.3 | 0.8 | 1.0 | 4.2 | 1.785 | 1.702 | 1.743 | 5.98 | 6.62 | 6.30 |
| 13 | 1.0 | 0.7 | 0.8 | 4.4 | 1.779 | 1.707 | 1.743 | 6.11 | 6.73 | 6.42 |
| 14 | 3.5 | 2.5 | 2.4 | 1.7 | 1.827 | 1.738 | 1.782 | 3.67 | 4.01 | 3.84 |
| 15 | 1.8 | 1.0 | 1.5 | 3.8 | 1.762 | 1.692 | 1.727 | 4.78 | 5.23 | 5.01 |
| 16 | 3.4 | 2.4 | 2.2 | 1.6 | 1.818 | 1.735 | 1.776 | 3.47 | 3.80 | 3.63 |
| 17 | 1.4 | 0.8 | 1.4 | 3.4 | 1.761 | 1.690 | 1.725 | 4.41 | 4.89 | 4.65 |
| 18 | 3.5 | 2.4 | 2.3 | 1.7 | 1.804 | 1.733 | 1.769 | 3.29 | 3.62 | 3.46 |
| 19 | 3.5 | 3.0 | 3.7 | 1.2 | 1.768 | 1.688 | 1.728 | 2.12 | 2.35 | 2.23 |
| 20 | 3.6 | 2.2 | 2.6 | 1.2 | 1.747 | 1.675 | 1.711 | 2.04 | 2.25 | 2.14 |
| 21 | 3.4 | 2.5 | 2.3 | 1.8 | 1.833 | 1.752 | 1.793 | 3.89 | 4.28 | 4.08 |
| 22 | 3.3 | 2.4 | 2.5 | 1.6 | 1.838 | 1.752 | 1.795 | 3.79 | 4.17 | 3.98 |
| 23 | 3.5 | 2.3 | 2.4 | 1.6 | 1.837 | 1.766 | 1.802 | 3.80 | 4.15 | 3.98 |
| 24 | 3.4 | 2.5 | 2.2 | 1.7 | 1.835 | 1.753 | 1.794 | 3.85 | 4.20 | 4.02 |

TABLE 3

| Steel type | Steel composition Si amount (wt %) | Hot rolling condition Rolling Strain rate Z ($S^{-1}$) | Rolling reduction R (%) | Z/R ratio | Ratio of integrated intensity of (015) [100] before cold rolling to ransom texture (times) | Texture Ratio to random structure Regular Cube (100) [001] | Goss (011) [100] | <111> //ND | Magnetic properties Magnetic flux density $B_{50}$ (T) L | C | LC average | Iron loss $W_{15/50}$ (W/kg) L | C | LC average |
|---|---|---|---|---|---|---|---|---|---|---|---|---|---|---|
| a | 0.5 | 33 | 60 | 0.55 | 4.5 | 3.5 | 3.5 | 1.0 | 1.924 | 1.845 | 1.884 | 4.39 | 4.94 | 4.66 |
| b | 0.5 | 20 | 40 | 0.51 | 3.4 | 3.0 | 3.2 | 1.3 | 1.913 | 1.832 | 1.872 | 4.65 | 5.18 | 4.91 |
| c | 0.5 | 24 | 50 | 0.47 | 2.6 | 1.7 | 1.8 | 2.4 | 1.872 | 1.786 | 1.829 | 5.58 | 6.12 | 5.85 |
| d | 0.5 | 24 | 60 | 0.40 | 1.2 | 1.1 | 2.1 | 3.4 | 1.845 | 1.764 | 1.804 | 6.23 | 6.74 | 6.48 |
| e | 1.0 | 28 | 50 | 0.55 | 4.8 | 4.4 | 3.5 | 1.1 | 1.905 | 1.830 | 1.868 | 4.00 | 4.47 | 4.23 |
| f | 1.0 | 17 | 35 | 0.49 | 3.8 | 3.6 | 3.5 | 1.4 | 1.894 | 1.811 | 1.852 | 4.23 | 4.70 | 4.47 |
| g | 1.0 | 23 | 50 | 0.45 | 2.6 | 1.7 | 2.1 | 2.2 | 1.857 | 1.775 | 1.816 | 4.96 | 5.47 | 5.22 |
| h | 1.0 | 14 | 35 | 0.40 | 1.1 | 1.0 | 1.7 | 3.7 | 1.814 | 1.726 | 1.770 | 5.91 | 6.38 | 6.15 |
| i | 1.5 | 20 | 40 | 9.51 | 4.8 | 3.8 | 3.2 | 0.9 | 1.884 | 1.802 | 1.843 | 3.59 | 4.01 | 3.80 |
| j | 1.5 | 23 | 50 | 0.46 | 3.6 | 3.1 | 3.3 | 1.4 | 1.867 | 1.782 | 1.825 | 3.92 | 4.32 | 4.12 |
| k | 1.5 | 22 | 50 | 0.43 | 1.7 | 1.3 | 1.7 | 2.9 | 1.814 | 1.734 | 1.774 | 4.93 | 5.37 | 5.15 |
| l | 2.1 | 35 | 70 | 0.50 | 5.8 | 7.0 | 3.5 | 0.8 | 1.900 | 1.818 | 1.859 | 2.76 | 3.16 | 2.96 |
| m | 2.1 | 18 | 40 | 0.45 | 4.1 | 6.5 | 3.5 | 0.9 | 1.895 | 1.807 | 1.851 | 2.83 | 3.20 | 3.02 |
| n | 2.1 | 26 | 65 | 0.40 | 2.7 | 1.8 | 1.7 | 2.4 | 1.825 | 1.737 | 1.781 | 3.89 | 4.27 | 4.08 |
| o | 2.1 | 21 | 60 | 0.35 | 1.2 | 1.4 | 1.7 | 3.9 | 1.785 | 1.703 | 1.744 | 4.57 | 4.91 | 4.74 |
| p | 3.2 | 27 | 60 | 0.45 | 5.1 | 6.0 | 3.5 | 0.7 | 1.839 | 1.765 | 1.802 | 2.03 | 2.32 | 2.18 |
| q | 3.2 | 16 | 40 | 0.40 | 3.8 | 3.1 | 3.1 | 1.4 | 1.804 | 1.733 | 1.769 | 2.42 | 2.70 | 2.56 |
| r | 3.2 | 12 | 35 | 0.35 | 2.0 | 1.4 | 1.7 | 2.8 | 1.755 | 1.676 | 1.715 | 3.00 | 3.28 | 3.14 |

TABLE 4

| Slab No. | Chemical composition (wt %) Si | P | Al | Mn | Cr | Mo | W | Cu | Ni | Co |
|---|---|---|---|---|---|---|---|---|---|---|
| 1 | 0.3 | 0.008 | 0.02 | 0.04 | | | | | | |
| 2 | 0.7 | 0.012 | 0.03 | 0.03 | | | | | | |
| 3 | 1.3 | 0.009 | 0.03 | 0.02 | | | | | | |
| 4 | 2.1 | 0.006 | 0.04 | 0.03 | | | | | | |
| 5 | 3.3 | 0.015 | 0.03 | 0.04 | | | | | | |
| 6 | 4.2 | 0.005 | 0.03 | 0.03 | | | | | | |
| 7 | 2.1 | 0.020 | 0.25 | 0.20 | | | | | | |
| 8 | 2.1 | 0.040 | 0.60 | 0.20 | | | | | | |
| 9 | 3.2 | 0.012 | 0.60 | 0.20 | | | | | | |
| 10 | 2.4 | 0.020 | 0.20 | 0.15 | 2.0 | | | | | |
| 11 | 3.2 | 0.015 | 0.20 | 0.20 | 2.5 | | | | | |
| 12 | 1.6 | 0.010 | 0.40 | 0.25 | | 0.2 | 0.2 | 0.2 | | |
| 13 | 2.2 | 0.025 | 0.20 | 0.25 | | | | | 0.3 | 0.3 |
| 14 | 2.1 | 0.350 | 2.40 | 0.20 | | | | | | |
| 15 | 1.8 | 0.020 | 0.60 | 2.40 | | | | | | |
| 16 | 1.9 | 0.040 | 0.40 | 0.03 | | 2.5 | | | | |
| 17 | 2.8 | 0.020 | 0.40 | 0.20 | 1.0 | | | | 2.5 | |
| 18 | 1.8 | 0.020 | 0.20 | 0.50 | | | | | 1.5 | |
| 19 | 2.1 | 0.020 | 0.20 | 0.80 | | | | | 0.8 | |
| 20 | 2.1 | 0.015 | 0.30 | 0.20 | | | | | | |
| 21 | 2.1 | 0.015 | 0.30 | 0.20 | | | | | | |
| 22 | 2.1 | 0.015 | 0.30 | 0.20 | | | | | | |
| 23 | 2.1 | 0.015 | 0.30 | 0.20 | | | | | | |
| 24 | 1.6 | 0.030 | 0.25 | 0.15 | | | | | | |
| 25 | 1.6 | 0.030 | 0.25 | 0.15 | | | | | | |
| 26 | 2.5 | 0.028 | 0.40 | 0.20 | | | | | | |
| 27 | 2.1 | 0.040 | 0.30 | 0.15 | | | | | | |
| 28 | 2.1 | 0.040 | 0.30 | 0.15 | | | | | | |
| 29 | 2.1 | 0.025 | 0.30 | 0.20 | | | | | | |

TABLE 5

| Slab | Chemical composition (wt %) | | | | | | | | | | | | | |
|---|---|---|---|---|---|---|---|---|---|---|---|---|---|---|
| No. | Ti | V | Nb | Zr | Ta | As | Sb | Sn | C | S | B | N | O | f* |
| 1 | 0.0005 | 0.0010 | 0.0010 | 0.001 | 0.001 | <0.01 | <0.01 | <0.01 | 0.0020 | 0.002 | 0.0002 | 0.0013 | 0.0013 | 0.4 |
| 2 | 0.0010 | 0.0004 | 0.0004 | 0.001 | 0.001 | <0.01 | <0.01 | <0.01 | 0.0011 | 0.002 | 0.0002 | 0.0008 | 0.0015 | 1.1 |
| 3 | 0.0020 | 0.0020 | 0.0020 | 0.001 | 0.001 | 0.01 | <0.01 | <0.01 | 0.0030 | 0.002 | 0.0002 | 0.0012 | 0.0014 | 1.9 |
| 4 | 0.0030 | 0.0010 | 0.0010 | 0.001 | 0.001 | <0.01 | <0.01 | <0.01 | 0.0040 | 0.003 | 0.0010 | 0.0015 | 0.0015 | 3.1 |
| 5 | 0.0005 | 0.0030 | 0.0030 | 0.002 | 0.001 | <0.01 | 0.01 | 0.01 | 0.0004 | 0.004 | 0.0002 | 0.0015 | 0.0013 | 5.0 |
| 6 | 0.0020 | 0.0020 | 0.0020 | 0.001 | 0.001 | <0.01 | <0.01 | 0.01 | 0.0020 | 0.008 | 0.0002 | 0.0012 | 0.0015 | 6.3 |
| 7 | 0.0007 | 0.0004 | 0.0004 | 0.001 | 0.001 | 0.01 | <0.01 | <0.01 | 0.0020 | 0.001 | 0.0002 | 0.0012 | 0.0011 | 3.6 |
| 8 | 0.0030 | 0.0007 | 0.0007 | 0.002 | 0.001 | <0.01 | 0.01 | <0.01 | 0.0030 | 0.006 | 0.0002 | 0.0013 | 0.0015 | 4.5 |
| 9 | 0.0030 | 0.0020 | 0.0020 | 0.001 | 0.001 | <0.01 | <0.01 | <0.01 | 0.0020 | 0.002 | 0.0002 | 0.0012 | 0.0012 | 6.1 |
| 10 | 0.0004 | 0.0020 | 0.0020 | 0.001 | 0.001 | 0.01 | <0.01 | <0.01 | 0.0040 | 0.007 | 0.0002 | 0.0014 | 0.0011 | 5.9 |
| 11 | 0.0030 | 0.0020 | 0.0020 | 0.001 | 0.001 | <0.01 | <0.01 | 0.01 | 0.0020 | 0.002 | 0.0002 | 0.0012 | 0.0012 | 7.6 |
| 12 | 0.0030 | 0.0020 | 0.0020 | 0.001 | 0.001 | 0.01 | <0.01 | <0.01 | 0.0050 | 0.008 | 0.0002 | 0.0016 | 0.0013 | 3.4 |
| 13 | 0.0020 | 0.0010 | 0.0010 | 0.002 | 0.001 | <0.01 | 0.01 | <0.01 | 0.0040 | 0.002 | 0.0002 | 0.0011 | 0.0018 | 3.3 |
| 14 | 0.0010 | 0.0030 | 0.0030 | 0.001 | 0.001 | <0.01 | <0.01 | <0.01 | 0.0020 | 0.002 | 0.0002 | 0.0012 | 0.0017 | 9.7 |
| 15 | 0.0030 | 0.0020 | 0.0020 | 0.001 | 0.001 | <0.01 | <0.01 | 0.01 | 0.0020 | 0.003 | 0.0002 | 0.0018 | 0.0018 | 2.9 |
| 16 | 0.0010 | 0.0020 | 0.0020 | 0.002 | 0.001 | <0.01 | <0.01 | 0.01 | 0.0030 | 0.005 | 0.0002 | 0.0017 | 0.0015 | 6.3 |
| 17 | 0.0020 | 0.0010 | 0.0010 | 0.001 | 0.001 | <0.01 | <0.01 | 0.01 | 0.0020 | 0.002 | 0.0002 | 0.0012 | 0.0015 | 3.5 |
| 18 | 0.0020 | 0.0010 | 0.0010 | 0.001 | 0.001 | 0.01 | <0.01 | <0.01 | 0.0020 | 0.006 | 0.0002 | 0.0012 | 0.0011 | 1.4 |
| 19 | 0.0020 | 0.0010 | 0.0010 | 0.001 | 0.001 | 0.01 | <0.01 | <0.01 | 0.0040 | 0.006 | 0.0002 | 0.0012 | 0.0011 | 2.3 |
| 20 | 0.0400 | 0.0010 | 0.0010 | 0.002 | 0.001 | 0.01 | 0.01 | <0.01 | 0.0070 | 0.015 | 0.0002 | 0.0012 | 0.0015 | 3.6 |
| 21 | 0.2800 | 0.0010 | 0.0010 | 0.002 | 0.001 | 0.01 | 0.01 | <0.01 | 0.0600 | 0.015 | 0.0002 | 0.0012 | 0.0015 | 2.0 |
| 22 | 0.0005 | 0.0200 | 0.0100 | 0.002 | 0.001 | 0.01 | 0.01 | <0.01 | 0.0050 | 0.002 | 0.0002 | 0.0060 | 0.0015 | 3.5 |
| 23 | 0.0010 | 0.0010 | 0.0010 | 0.050 | 0.050 | 0.01 | 0.01 | <0.01 | 0.0080 | 0.002 | 0.0002 | 0.0040 | 0.0070 | 3.5 |
| 24 | 0.0020 | 0.0010 | 0.0010 | 0.001 | 0.001 | 0.04 | <0.01 | <0.01 | 0.0020 | 0.002 | 0.0002 | 0.0012 | 0.0015 | 2.9 |
| 25 | 0.0020 | 0.0010 | 0.0010 | 0.001 | 0.001 | 0.25 | <0.01 | <0.01 | 0.0020 | 0.002 | 0.0002 | 0.0012 | 0.0015 | 2.9 |
| 26 | 0.0010 | 0.0010 | 0.0010 | 0.001 | 0.001 | <0.01 | 0.05 | 0.03 | 0.0020 | 0.002 | 0.0002 | 0.0012 | 0.0015 | 4.6 |
| 27 | 0.0030 | 0.0020 | 0.0020 | 0.001 | 0.001 | 0.01 | 0.01 | <0.01 | 0.0080 | 0.002 | 0.0002 | 0.0012 | 0.0015 | 3.6 |
| 28 | 0.0030 | 0.0020 | 0.0020 | 0.001 | 0.001 | 0.01 | 0.01 | <0.01 | 0.0700 | 0.002 | 0.0002 | 0.0012 | 0.0015 | 1.8 |
| 29 | 0.0010 | 0.0010 | 0.0010 | 0.002 | 0.001 | <0.01 | <0.01 | 0.01 | 0.0020 | 0.007 | 0.0040 | 0.0060 | 0.0015 | 3.6 |

*f: nontransformation index

TABLE 6-1

| | | Heating condition | | Finish milling condition | | | | | | Ratio of | | |
|---|---|---|---|---|---|---|---|---|---|---|---|---|
| Steel No. | Slab No. | Slab heating temperature (° C.) | Heating or heat insulation before finish milling (° C.) | Finisher entrance temperature (° C.) | Ar1 transformation temperature (° C.) | Volume fraction of equiaxed ferrite grains (%) | Average ferrite grain size (μm) | Volume fraction of grains of 100 μm or less (%) | Minimum Z/R ratio | integrated intensity of (015) [001] before cold rolling to random structure | Rolling reduction of cold rolling (%) | |
| 1 | 1 | 1200 | — | 700 | 920 | 100 | 350 | 5 | 0.60 | 3.5 | 65 | A |
| 2 | 2 | 1200 | — | 800 | 940 | 100 | 400 | 5 | 0.55 | 4.0 | 70 | |
| 3 | 3 | 1200 | — | 800 | 980 | 95 | 450 | 5 | 0.50 | 5.0 | 65 | |
| 4 | 4 | 1250 | — | 840 | — | 90 | 750 | 0 | 0.50 | 6.0 | 70 | |
| 5 | 5 | 1250 | — | 850 | — | 85 | 800 | 0 | 0.45 | 6.4 | 65 | |
| 6 | 6 | 1250 | — | 850 | — | 82 | 800 | 0 | 0.40 | 3.5 | 65 | B |
| 7 | 7 | 1100 | — | 970 | — | 70 | 250 | 40 | 0.25 | 1.5 | 85 | C |
| 8 | 7 | 1250 | — | 830 | — | 100 | 900 | 0 | 0.55 | 9.5 | 68 | A |
| 9 | 7 | 1200 | — | 800 | — | 95 | 800 | 0 | 0.50 | 8.7 | 65 | |
| 10 | 7 | 1050 | — | 830 | — | 85 | 550 | 10 | 0.55 | 3.2 | 68 | |
| 11 | 7 | 1050 | 1030 | 850 | — | 95 | 900 | 0 | 0.45 | 10.0 | 68 | |
| 12 | 7 | 1250 | — | 1000 | — | 100 | 850 | 0 | 0.50 | 1.5 | 68 | B |
| 13 | 7 | 1250 | — | 940 | — | 100 | 750 | 0 | 0.50 | 1.7 | 68 | |
| 14 | 7 | 1060 | — | 850 | — | 85 | 600 | 5 | 0.50 | 3.5 | 68 | A |
| 15 | 7 | 1060 | — | 850 | — | 65 | 350 | 15 | 0.45 | 2.3 | 68 | B |
| 16 | 7 | 1060 | — | 850 | — | 85 | 200 | 30 | 0.55 | 2.0 | 68 | |
| 17 | 7 | 1250 | — | 850 | — | 100 | 800 | 0 | 0.30 | 2.5 | 68 | |
| 18 | 7 | 1250 | — | 850 | — | 95 | 750 | 0 | 0.20 | 1.8 | 68 | |
| 19 | 7 | 1250 | — | 850 | — | 100 | 900 | 0 | 0.50 | 9.5 | 90 | A |
| 20 | 7 | 1250 | — | 850 | — | 95 | 850 | 0 | 0.50 | 9.5 | 45 | |
| 21 | 8 | 1200 | — | 860 | — | 100 | 850 | 0 | 0.45 | 8.0 | 65 | |
| 22 | 9 | 1200 | — | 850 | — | 90 | 850 | 0 | 0.45 | 7.0 | 65 | |
| 23 | 10 | 1200 | — | 850 | — | 100 | 850 | 0 | 0.50 | 7.5 | 60 | |
| 24 | 11 | 1250 | — | 880 | — | 95 | 850 | 0 | 0.45 | 6.0 | 70 | |

A: Example of this invention, B: comparative Example, C: Conventional Example

TABLE 7-1

| Steel No. | Texture: Regular Cube (100) [001] Ratio to random structure | Texture: Goss (011) [100] Ratio to random structure | Texture: <111> //ND Ratio to random structure | Magnetic properties: Magnetic flux density $B_{50}$ (T) L | C | LC average | Iron loss $W_{15/50}$ (W/kg) L | C | LC average | |
|---|---|---|---|---|---|---|---|---|---|---|
| 1 | 3.0 | 2.5 | 1.3 | 1.917 | 1.841 | 1.879 | 4.86 | 5.41 | 5.14 | A |
| 2 | 3.5 | 3.5 | 1.1 | 1.913 | 1.837 | 1.875 | 4.29 | 4.78 | 4.53 | |
| 3 | 5.0 | 4.5 | 1.1 | 1.900 | 1.825 | 1.863 | 3.65 | 4.07 | 3.86 | |
| 4 | 7.0 | 3.5 | 0.8 | 1.900 | 1.823 | 1.861 | 2.75 | 3.11 | 2.93 | |
| 5 | 6.0 | 3.5 | 0.7 | 1.833 | 1.745 | 1.789 | 1.95 | 2.20 | 2.08 | |
| 6 | 3.0 | 1.8 | 2.5 | 1.712 | 1.624 | 1.668 | 1.88 | 2.08 | 1.98 | B |
| 7 | 1.2 | 1.5 | 3.6 | 1.825 | 1.745 | 1.785 | 4.14 | 4.50 | 4.32 | C |
| 8 | 8.0 | 3.8 | 0.7 | 1.943 | 1.864 | 1.903 | 2.44 | 2.78 | 2.61 | A |
| 9 | 7.7 | 3.7 | 0.8 | 1.938 | 1.806 | 1.902 | 2.50 | 2.82 | 2.66 | |
| 10 | 3.2 | 2.3 | 1.8 | 1.880 | 1.806 | 1.843 | 3.30 | 3.67 | 3.48 | |
| 11 | 8.5 | 3.5 | 0.8 | 1.941 | 1.866 | 1.904 | 2.47 | 2.84 | 2.65 | |
| 12 | 1.1 | 2.4 | 3.5 | 1.831 | 1.758 | 1.795 | 4.06 | 4.38 | 4.22 | B |
| 13 | 1.7 | 2.6 | 3.8 | 1.828 | 1.743 | 1.785 | 4.13 | 4.50 | 4.31 | |
| 14 | 3.1 | 2.2 | 1.7 | 1.881 | 1.810 | 1.846 | 3.27 | 3.63 | 3.45 | A |
| 15 | 1.6 | 2.2 | 2.9 | 1.848 | 1.760 | 1.804 | 3.80 | 4.14 | 3.97 | B |
| 16 | 1.2 | 4.2 | 3.8 | 1.833 | 1.761 | 1.797 | 4.07 | 4.45 | 4.26 | |
| 17 | 1.1 | 2.1 | 3.4 | 1.832 | 1.747 | 1.790 | 4.03 | 4.40 | 4.22 | |
| 18 | 1.1 | 2.0 | 3.6 | 1.827 | 1.752 | 1.789 | 4.12 | 4.46 | 4.29 | |
| 19 | 3.1 | 2.1 | 1.9 | 1.876 | 1.804 | 1.840 | 3.36 | 3.70 | 3.53 | A |
| 20 | 3.2 | 2.2 | 1.9 | 1.876 | 1.791 | 1.834 | 3.36 | 3.70 | 3.53 | |
| 21 | 7.0 | 3.0 | 0.7 | 1.914 | 1.834 | 1.874 | 2.32 | 2.64 | 2.48 | |
| 22 | 7.5 | 3.5 | 0.8 | 1.809 | 1.727 | 1.768 | 1.89 | 2.14 | 2.01 | |
| 23 | 7.0 | 3.0 | 0.7 | 1.916 | 1.830 | 1.873 | 2.14 | 2.44 | 2.29 | |
| 24 | 8.0 | 4.0 | 0.8 | 1.870 | 1.786 | 1.828 | 1.74 | 1.96 | 1.85 | |

A: Example of this invention, B: Comparative Example, C: Conventional Example

TABLE 7-2

| Steel No. | Texture: Regular Cube (100) [001] Ratio to random structure | Texture: Goss (011) [100] Ratio to random structure | Texture: <111> //ND Ratio to random structure | Magnetic properties: Magnetic flux density $B_{50}$ (T) L | C | LC average | Iron loss $W_{15/50}$ (W/kg) L | C | LC average | |
|---|---|---|---|---|---|---|---|---|---|---|
| 25 | 1.2 | 1.8 | 3.2 | 1.773 | 1.690 | 1.732 | 2.83 | 3.06 | 2.95 | C |
| 26 | 4.5 | 2.5 | 1.2 | 1.917 | 1.838 | 1.877 | 3.13 | 3.51 | 3.32 | A |
| 27 | 6.5 | 3.0 | 0.9 | 1.926 | 1.849 | 1.887 | 2.52 | 2.82 | 2.67 | |
| 28 | 5.5 | 2.5 | 0.8 | 1.746 | 1.674 | 1.710 | 2.04 | 2.27 | 2.15 | |
| 29 | 5.0 | 3.0 | 1.0 | 1.828 | 1.749 | 1.788 | 2.03 | 2.26 | 2.15 | |
| 30 | 4.0 | 2.5 | 0.9 | 1.831 | 1.744 | 1.787 | 2.46 | 2.74 | 2.60 | |
| 31 | 4.3 | 3.0 | 1.0 | 1.881 | 1.804 | 1.842 | 2.85 | 3.21 | 3.03 | |
| 32 | 2.8 | 2.8 | 1.3 | 1.858 | 1.782 | 1.820 | 3.28 | 3.68 | 3.48 | |
| 33 | 3.4 | 3.0 | 1.2 | 1.843 | 1.760 | 1.801 | 2.91 | 3.26 | 3.08 | |
| 34 | 6.0 | 3.0 | 0.9 | 1.871 | 1.789 | 1.830 | 2.89 | 3.24 | 3.06 | |
| 35 | 2.4 | 2.6 | 1.4 | 1.795 | 1.709 | 1.752 | 4.05 | 4.42 | 4.23 | |
| 36 | 6.2 | 3.2 | 1.0 | 1.871 | 1.799 | 1.835 | 2.91 | 3.31 | 3.11 | |
| 37 | 5.8 | 3.1 | 0.8 | 1.873 | 1.799 | 1.836 | 2.85 | 3.22 | 3.03 | |
| 38 | 6.1 | 2.5 | 1.0 | 1.894 | 1.822 | 1.858 | 3.35 | 3.77 | 3.56 | |
| 39 | 2.6 | 2.7 | 1.7 | 1.817 | 1.742 | 1.779 | 4.58 | 5.08 | 4.82 | |
| 40 | 5.8 | 3.0 | 0.9 | 1.844 | 1.767 | 1.805 | 2.54 | 2.89 | 2.71 | |
| 41 | 6.2 | 3.5 | 0.8 | 1.877 | 1.788 | 1.833 | 2.80 | 3.16 | 2.98 | |
| 42 | 2.7 | 2.8 | 1.6 | 1.789 | 1.719 | 1.754 | 4.06 | 4.44 | 4.25 | |
| 43 | 6.0 | 2.5 | 1.2 | 1.861 | 1.786 | 1.823 | 3.04 | 3.39 | 3.22 | |

A: Example of this invention, B: Comparative Example, C: Conventional Example

TABLE 8

| Steel slab type | Chemical Composition (wt %) Si | P | Al | Mn |
|---|---|---|---|---|
| a | 0.1 | 0.008 | 0.20 | 0.25 |
| b | 1.2 | 0.015 | 0.25 | 0.30 |
| c | 2.1 | 0.020 | 0.15 | 0.25 |
| d | 3.2 | 0.008 | 0.30 | 0.30 |
| e | 4.3 | 0.005 | 0.22 | 0.26 |

TABLE 9

| | | | Heating condition | | Finish milling condition | | | | | |
|---|---|---|---|---|---|---|---|---|---|---|
| Steel No. | *1) Claim | Steel slab type Basic Dependent | Slab heating temp. ° C. Optimum 1100~1500 | Heating or heat insulation before finish milling ° C. Optimum 1000~1150 | Finisher entrance temp. ° C. 900, $Ar_1$~500 | Ar1 transformation temp. ° C. | Volume fraction of equiazed ferrite grain % ≧80 | Average ferrite grain size μm ≧300 Optimum ≧650 | Volume fraction of grains of 100 μm or less % ≦20 | Initial rolling reduction % 10~30 10~25 |
| 1 | A | a | 1120 | No | 700 | 930 | 100 | 350 | 5 | 18 |
| 2 | B | a | 1130 | No | 700 | 930 | 100 | 340 | 5 | 36 |
| 3 | B | a | 1120 | No | 920 | 930 | 100 | 360 | 0 | 22 |
| 4 | B | a | 1140 | No | 700 | 930 | 100 | 180 | 25 | 24 |
| 5 | A | b | 1150 | No | 820 | 980 | 100 | 380 | 0 | 19 |
| 6 | A | b | 1160 | No | 820 | 980 | 100 | 400 | 0 | 26 |
| 7 | B | b | 1150 | No | 820 | 980 | 100 | 400 | 0 | 50 |
| 8 | B | b | 1140 | No | 820 | 980 | 100 | 390 | 0 | 40 |
| 9 | B | b | 1120 | No | 950 | 980 | 95 | 420 | 0 | 23 |
| 10 | B | b | 1120 | No | 820 | 980 | 85 | 180 | 25 | 24 |
| 11 | A | c | 1150 | No | 850 | — | 95 | 700 | 0 | 20 |
| 12 | B | c | 1130 | No | 820 | — | 95 | 650 | 0 | 40 |
| 13 | B | c | 1120 | No | 840 | — | 95 | 700 | 0 | 45 |
| 14 | B | c | 1150 | No | 980 | — | 100 | 900 | 0 | 22 |
| 15 | A | d | 1120 | 1060 | 880 | — | 100 | 1000 | 0 | 18 |
| 16 | A | d | 1150 | No | 860 | — | 85 | 500 | 0 | 27 |
| 17 | B | d | 1140 | No | 850 | — | 90 | 900 | 0 | 42 |
| 18 | B | d | 1150 | No | 980 | — | 85 | 850 | 0 | 20 |
| 19 | B | d | 1150 | No | 850 | — | 70 | 800 | 0 | 22 |
| 20 | B | e | 1150 | 1050 | 860 | — | 100 | 600 | 0 | 25 |
| 21 | B | e | 1200 | No | 1020 | — | 70 | 400 | 25 | 45 |

| | Texture | | | | | | | | | |
|---|---|---|---|---|---|---|---|---|---|---|
| | After hot rolling-recrystallization | After cold rolling and annealing | | | | | | | | |
| | Ratio to random structure | | | | | | | | | |
| | Regular | | | | Magnetic properties | | | | | |
| | | Cube | | | $B_{50}$ (T) | | | $W_{15/50}$ (W/kg) | | |
| Steel No. | (015) [100] ≧3.0 | (100) [011] ≧2.0 | Goss (011) [100] 2.0~10 | <111> //ND ≦2.0 | L | C | LC average | L | C | LC average |
| 1 | 6.00 | 4.0 | 2.8 | 1.1 | 1.931 | 1.857 | 1.894 | 4.13 | 4.58 | 4.36 |
| 2 | 2.20 | 1.4 | 1.7 | 2.4 | 1.880 | 1.803 | 1.841 | 5.19 | 5.71 | 5.45 |
| 3 | 1.40 | 1.1 | 1.2 | 2.8 | 1.866 | 1.787 | 1.826 | 5.49 | 6.01 | 5.75 |
| 4 | 1.80 | 1.2 | 1.3 | 3.2 | 1.857 | 1.782 | 1.820 | 5.71 | 6.26 | 5.98 |
| 5 | 7.20 | 7.5 | 3.4 | 0.9 | 1.923 | 1.833 | 1.878 | 3.15 | 3.45 | 3.30 |
| 6 | 4.20 | 5.5 | 2.8 | 1.2 | 1.903 | 1.813 | 1.858 | 3.48 | 3.85 | 3.67 |
| 7 | 0.90 | 1.0 | 1.2 | 3.4 | 1.817 | 1.737 | 1.777 | 5.01 | 5.49 | 5.25 |

TABLE 9-continued

| | | | | | | | | | | |
|---|---|---|---|---|---|---|---|---|---|---|
| 8 | 2.20 | 1.7 | 1.2 | 2.8 | 1.836 | 1.754 | 1.795 | 4.66 | 5.11 | 4.88 |
| 9 | 1.70 | 1.4 | 1.5 | 3.4 | 1.821 | 1.748 | 1.784 | 4.96 | 5.46 | 5.21 |
| 10 | 1.20 | 1.0 | 1.4 | 3.2 | 1.823 | 1.749 | 1.786 | 4.90 | 5.36 | 5.13 |
| 11 | 8.20 | 8.0 | 3.8 | 0.7 | 1.897 | 1.821 | 1.859 | 2.48 | 2.72 | 2.60 |
| 12 | 1.70 | 1.4 | 1.2 | 3.4 | 1.784 | 1.710 | 1.747 | 4.13 | 4.54 | 4.34 |
| 13 | 2.00 | 1.7 | 1.4 | 3.2 | 1.791 | 1.708 | 1.750 | 4.02 | 4.39 | 4.21 |
| 14 | 1.50 | 1.1 | 1.4 | 3.3 | 1.786 | 1.711 | 1.749 | 4.10 | 4.48 | 4.29 |
| 15 | 9.40 | 9.5 | 3.4 | 0.8 | 1.833 | 1.753 | 1.793 | 1.67 | 1.85 | 1.76 |
| 16 | 5.40 | 4.5 | 2.9 | 1.3 | 1.793 | 1.708 | 1.751 | 2.03 | 2.21 | 2.12 |
| 17 | 1.40 | 1.5 | 1.4 | 3.0 | 1.728 | 1.646 | 1.687 | 2.68 | 2.93 | 2.81 |
| 18 | 1.60 | 1.2 | 1.4 | 2.8 | 1.731 | 1.645 | 1.688 | 2.64 | 2.91 | 2.78 |
| 19 | 1.50 | 1.3 | 1.2 | 2.9 | 1.728 | 1.648 | 1.688 | 2.67 | 2.92 | 2.80 |
| 20 | 1.30 | 1.0 | 1.2 | 3.4 | 1.654 | 1.584 | 1.619 | 1.74 | 1.90 | 1.82 |
| 21 | 1.00 | 1.1 | 1.1 | 3.3 | 1.656 | 1.580 | 1.618 | 1.73 | 1.91 | 1.82 |

A: Example of this invention, B: Comparative Example, C: Conventional Example
*1) Discrimination of the invention

TABLE 10

| Steel slab | Chemical Composition (wt %) | | | |
|---|---|---|---|---|
| type | Si | P | Al | Mn |
| a | 0.1 | 0.008 | 0.20 | 0.25 |
| b | 1.2 | 0.015 | 0.25 | 0.30 |
| c | 2.1 | 0.020 | 0.15 | 0.25 |
| d | 3.2 | 0.008 | 0.30 | 0.30 |
| e | 4.2 | 0.008 | 0.22 | 0.24 |

TABLE 11

| | | | Heating condition | | Finish milling condition | | | |
|---|---|---|---|---|---|---|---|---|
| Steel No. | *1) Claim | Steel slab type Basic Dependent | Slab heating temp. ° C. Optimum 1100~1500 | Heating or heat insulation before finish milling ° C. Optimum 1000~1150 | Finisher entrance temp. ° C. 900, $Ar_1$~500 | Ar1 transformation temp. ° C. | Total rolling reduction % 70~90 | Interlayer spacing μm ≧250 Optimum 250~500 |
| 1 | A | a | 1120 | No | 700 | 930 | 85 | 280 |
| 2 | B | a | 1120 | No | 920 | 930 | 85 | 120 |
| 3 | B | a | 1130 | No | 720 | 930 | 60 | 350 |
| 4 | B | a | 1150 | No | 700 | 930 | 85 | 180 |
| 5 | A | b | 1120 | 1030 | 860 | 980 | 80 | 320 |
| 6 | B | b | 1150 | No | 940 | 980 | 87 | 150 |
| 7 | B | b | 1130 | No | 820 | 980 | 60 | 330 |
| 8 | B | b | 1150 | No | 820 | 980 | 86 | 150 |
| 9 | A | c | 1150 | No | 850 | — | 78 | 400 |
| 10 | B | c | 1150 | No | 960 | — | 86 | 180 |
| 11 | B | c | 1150 | No | 840 | — | 61 | 340 |
| 12 | B | c | 1150 | No | 860 | — | 86 | 180 |
| 13 | B | c | 1150 | No | 860 | — | 95 | 180 |
| 14 | A | d | 1170 | No | 880 | — | 85 | 300 |
| 15 | B | d | 1150 | No | 860 | — | 84 | 200 |
| 16 | B | e | 1150 | 1050 | 860 | — | 83 | 280 |
| 17 | B | e | 1150 | No | 1050 | — | 94 | 70 |

TABLE 11-continued

| | Texture | | | | | | | | | |
|---|---|---|---|---|---|---|---|---|---|---|
| | After hot rolling-recrystallization | After cold rolling and annealing | | | | | | | | |
| | Ratio to random structure | | | | | | | | | |
| | Regular | | | | Magnetic properties | | | | | |
| | Cube | | | | $B_{50}$ (T) | | | $W_{15/50}$ (W/kg) | | |
| Steel No. | (015) [100] ≧3.0 | (100) [011] ≧2.0 | Goss (011) [100] 2.0~10 | <111> //ND ≦2.0 | L | C | LC average | L | C | LC average |
| 1 | 6.8 | 3.9 | 2.6 | 1.2 | 1.927 | 1.850 | 1.889 | 4.22 | 4.65 | 4.44 |
| 2 | 1.5 | 1.2 | 1.5 | 3.4 | 1.853 | 1.776 | 1.815 | 5.81 | 6.35 | 6.08 |
| 3 | 2.1 | 1.5 | 1.7 | 2.5 | 1.878 | 1.797 | 1.837 | 5.24 | 5.77 | 5.51 |
| 4 | 2.2 | 1.3 | 1.8 | 2.3 | 1.882 | 1.811 | 1.847 | 5.14 | 5.61 | 5.37 |
| 5 | 6.0 | 4.0 | 2.5 | 1.5 | 1.886 | 1.809 | 1.847 | 3.76 | 4.16 | 3.96 |
| 6 | 1.4 | 1.2 | 1.6 | 3.2 | 1.825 | 1.743 | 1.784 | 4.87 | 5.33 | 5.10 |
| 7 | 2.0 | 1.5 | 2.0 | 2.5 | 1.846 | 1.769 | 1.807 | 4.47 | 4.90 | 4.68 |
| 8 | 1.9 | 1.3 | 1.4 | 3.2 | 1.825 | 1.746 | 1.785 | 4.87 | 5.38 | 5.13 |
| 9 | 7.6 | 4.5 | 2.4 | 1.3 | 1.858 | 1.785 | 1.821 | 3.01 | 3.31 | 3.16 |
| 10 | 1.5 | 1.3 | 1.3 | 3.5 | 1.781 | 1.702 | 1.741 | 4.17 | 4.58 | 4.37 |
| 11 | 1.4 | 1.5 | 1.5 | 3.2 | 1.791 | 1.705 | 1.748 | 4.03 | 4.43 | 4.23 |
| 12 | 1.8 | 0.9 | 1.4 | 3.2 | 1.787 | 1.712 | 1.750 | 4.07 | 4.45 | 4.26 |
| 13 | 1.2 | 0.9 | 1.2 | 3.9 | 1.769 | 1.682 | 1.725 | 4.37 | 4.76 | 4.57 |
| 14 | 7.2 | 3.5 | 2.9 | 1.5 | 1.783 | 1.709 | 1.746 | 2.12 | 2.36 | 2.24 |
| 15 | 1.1 | 1.4 | 1.1 | 3.2 | 1.721 | 1.641 | 1.681 | 2.75 | 3.05 | 2.90 |
| 16 | 1.3 | 1.3 | 1.2 | 2.8 | 1.677 | 1.596 | 1.637 | 1.74 | 1.91 | 1.82 |
| 17 | 0.9 | 1.0 | 1.2 | 3.2 | 1.666 | 1.587 | 1.626 | 1.82 | 1.99 | 1.90 |

A: Example of this invention, B: Comparative Example, C: Conventional Example
*1) Discrimination of the production method

TABLE 12

| Steel slab | Chemical Composition (wt %) | | | |
|---|---|---|---|---|
| type | Si | P | Al | Mn |
| a | 0.5 | 0.008 | 0.20 | 0.25 |
| b | 1.2 | 0.015 | 0.25 | 0.30 |
| c | 2.1 | 0.020 | 0.15 | 0.25 |
| d | 3.2 | 0.008 | 0.30 | 0.30 |
| e | 4.2 | 0.008 | 0.22 | 0.24 |

TABLE 13

| | | | | Finish milling condition | | | | |
|---|---|---|---|---|---|---|---|---|
| Steel No. | *1) | Steel slab type | Heating condition Slab heating temp. (° C.) | Finisher entrance temp. (° C.) | Ar1 transformation temp. (° C.) | Steel structure at entrance of first stand | Effective accumulated strain R | Rolling reduction in final stand (%) |
| 1 | A | a | 1120 | 700 | 930 | α single | 2.0 | 38 |
| 2 | A | a | 1120 | 700 | 930 | α single | 1.5 | 30 |
| 3 | A | a | 1120 | 750 | 930 | α single | 1.6 | 40 |
| 4 | B | a | 1120 | 740 | 930 | α single | 1.6 | 12 |
| 5 | B | a | 1130 | 850 | 930 | α single | 0.3 | 35 |
| 6 | B | a | 1150 | 980 | 930 | α + γ | 0.1 | 40 |
| 7 | A | b | 1120 | 760 | 980 | α single | 1.5 | 35 |
| 8 | A | b | 1120 | 700 | 980 | α single | 2.0 | 40 |
| 9 | A | b | 1120 | 750 | 980 | α single | 1.6 | 38 |
| 10 | A | b | 1120 | 750 | 980 | α single | 1.4 | 30 |

TABLE 13-continued

| | | | | | | | | |
|---|---|---|---|---|---|---|---|---|
| 11 | B | b | 1150 | 740 | 980 | α single | 1.6 | 15 |
| 12 | B | b | 1130 | 850 | 980 | α single | 0.3 | 40 |
| 13 | B | b | 1150 | 1030 | 980 | α + γ | 0.1 | 35 |
| 14 | A | c | 1150 | 790 | — | α single | 1.3 | 40 |
| 15 | A | c | 1150 | 750 | — | α single | 2.0 | 38 |
| 16 | A | c | 1150 | 750 | — | α single | 1.8 | 35 |
| 17 | A | c | 1150 | 700 | — | α single | 2.0 | 30 |
| 18 | B | c | 1150 | 780 | | α single | 0.5 | 15 |
| 19 | B | c | 1150 | 860 | | α single | 0.3 | 38 |
| 20 | B | c | 1150 | 880 | | α single | 0.4 | 15 |
| 21 | B | c | 1150 | 820 | | α single | 0.4 | 25 |
| 22 | A | d | 1170 | 880 | | α single | 1.1 | 38 |
| 23 | A | d | 1170 | 850 | | α single | 1.5 | 35 |
| 24 | A | d | 1170 | 880 | | α single | 2.0 | 40 |
| 25 | B | d | 1150 | 860 | | α single | 0.3 | 20 |
| 26 | B | e | 1150 | 950 | | α single | 1.2 | 35 |
| 27 | B | e | 1150 | 950 | | α single | 0.5 | 20 |

| | Texture | | | | | | | | | |
|---|---|---|---|---|---|---|---|---|---|---|
| | After hot rolling-recrystallization | After cold rolling and annealing | | | | | | | | |
| | Ratio to random structure | | | | | | | | | |
| | Regular | | | | Magnetic properties | | | | | |
| | Cube | | | | $B_{50}$ (T) | | | $W_{15/50}$ (W/kg) | | |
| Steel No. | (015) [100] ≧3.0 | (100) [011] ≧2.0 | Goss (011) [100] 2.0~10 | <111> //ND ≦2.0 | L | C | LC average | L | C | LC average |
| 1 | 6.7 | 3.8 | 4.0 | 1.1 | 1.926 | 1.850 | 1.888 | 4.22 | 4.65 | 4.43 |
| 2 | 5.2 | 2.7 | 6.2 | 1.1 | 1.923 | 1.834 | 1.878 | 4.27 | 4.71 | 4.49 |
| 3 | 5.0 | 2.5 | 5.0 | 1.0 | 1.927 | 1.843 | 1.885 | 4.18 | 4.59 | 4.39 |
| 4 | 1.4 | 1.1 | 9.5 | 3.3 | 1.895 | 1.816 | 1.855 | 5.09 | 5.58 | 5.34 |
| 5 | 2.0 | 1.4 | 8.0 | 2.4 | 1.911 | 1.836 | 1.874 | 4.67 | 5.10 | 4.89 |
| 6 | 2.3 | 1.4 | 12.3 | 2.2 | 1.917 | 1.835 | 1.876 | 4.54 | 4.99 | 4.47 |
| 7 | 5.9 | 3.9 | 4.8 | 1.6 | 1.883 | 1.796 | 1.839 | 3.82 | 4.22 | 4.02 |
| 8 | 7.0 | 4.0 | 2.0 | 1.0 | 1.896 | 1.821 | 1.859 | 3.55 | 3.87 | 3.71 |
| 9 | 6.5 | 3.5 | 4.5 | 1.0 | 1.896 | 1.820 | 1.858 | 3.55 | 3.92 | 3.74 |
| 10 | 4.5 | 2.3 | 5.5 | 1.1 | 1.888 | 1.804 | 1.846 | 3.68 | 4.03 | 3.86 |
| 11 | 1.3 | 1.1 | 13.5 | 3.0 | 1.867 | 1.796 | 1.831 | 4.25 | 4.64 | 4.44 |
| 12 | 2.1 | 1.4 | 7.8 | 2.4 | 1.877 | 1.799 | 1.838 | 4.02 | 4.43 | 4.22 |
| 13 | 1.8 | 1.4 | 7.8 | 3.0 | 1.862 | 1.787 | 1.824 | 4.31 | 4.77 | 4.54 |
| 14 | 7.5 | 4.2 | 2.3 | 1.2 | 1.858 | 1.775 | 1.817 | 3.00 | 3.29 | 3.14 |
| 15 | 6.7 | 3.5 | 5.2 | 1.2 | 1.856 | 1.778 | 1.817 | 3.03 | 3.33 | 3.18 |
| 16 | 5.7 | 2.8 | 4.0 | 1.2 | 1.853 | 1.770 | 1.811 | 3.06 | 3.35 | 3.20 |
| 17 | 5.0 | 2.3 | 4.8 | 1.1 | 1.852 | 1.767 | 1.809 | 3.06 | 3.33 | 3.19 |
| 18 | 1.3 | 1.4 | 5.0 | 3.2 | 1.808 | 1.727 | 1.767 | 3.83 | 4.23 | 4.03 |
| 19 | 1.1 | 1.4 | 7.0 | 3.5 | 1.810 | 1.728 | 1.769 | 3.83 | 4.20 | 4.02 |
| 20 | 1.1 | 1.0 | 12.5 | 3.3 | 1.825 | 1.746 | 1.786 | 3.63 | 3.98 | 3.81 |
| 21 | 1.3 | 0.8 | 10.0 | 3.4 | 1.825 | 1.750 | 1.787 | 3.65 | 4.02 | 3.84 |
| 22 | 7.0 | 3.4 | 4.8 | 1.4 | 1.784 | 1.714 | 1.749 | 2.11 | 2.32 | 2.21 |
| 23 | 6.5 | 3.7 | 2.4 | 1.2 | 1.789 | 1.706 | 1.747 | 2.05 | 2.26 | 2.16 |
| 24 | 6.8 | 3.8 | 2.0 | 1.1 | 1.790 | 1.710 | 1.750 | 2.04 | 2.26 | 2.15 |
| 25 | 1.0 | 1.3 | 1.8 | 3.0 | 1.757 | 1.669 | 1.713 | 2.45 | 2.71 | 2.58 |
| 26 | 1.0 | 1.2 | 8.0 | 3.2 | 1.701 | 1.617 | 1.659 | 1.64 | 1.78 | 1.71 |
| 27 | 1.1 | 1.1 | 9.2 | 3.7 | 1.694 | 1.619 | 1.656 | 1.70 | 1.88 | 1.79 |

A: Example of this invention, B: Comparative Example,
*1) Discrimination of the production method

What is claimed is:

1. A magnetic steel sheet having excellent magnetic properties in the L direction and in the C direction, wherein said magnetic steel sheet is in a recrystallized cold-rolled sheet condition, said recrystallized cold-rolled magnetic steel sheet having an intensity ratio of {100}<001> orientation to random orientation of 2.0 or more and an intensity ratio of {011}<100> orientation to random orientation of 2.0 to 10.0.

2. A magnetic steel sheet according to claim 1, wherein said recrystallized cold-rolled magnetic steel sheet has an intensity ratio of <001>//ND orientation to random orientation of 2.0 or less.

3. A method of producing a magnetic steel sheet having excellent magnetic properties in the L direction and in the C direction, comprising the steps of: hot rough rolling a silicon steel slab to form a steel sheet; hot finish rolling said hot rough rolled steel sheet; optionally subjecting said hot finish rolled steel sheet to normalizing annealing, wherein said hot finish rolled steel sheet or said optionally annealed steel sheet is recrystallized hot rolled steel sheet and has an intensity ratio of (015)[100] orientation to random orientation of 3.0 or more; cold rolling said recrystallized hot rolled steel sheet; finish annealing said cold-rolled steel sheet, wherein said recrystallized cold rolled steel sheet has an intensity ratio of {100}<001> orientation to random orientation of 2.0 or more and an intensity ratio of {011}<100> orientation to random orientation of 2.0 to 10.0; and thereby producing a magnetic steel sheet.

4. A method of producing a magnetic steel sheet according to claim 3, wherein said hot rough rolled steel sheet has a structure having a volume fraction of equiaxed ferrite grains of 80% or more, an average grain size of equiaxed ferrite grains of 300 $\mu$m or more, and a volume fraction of recrystallized ferrite grains of 100 $\mu$m or less of 20% or less; wherein the temperature $T_a$ of a steel sheet having a composition bearing an austenite phase on the entrance side of a hot finish rolling mill satisfies the following equations: $T_a \leqq A_{r1}$ transformation temperature and 500° C.$\leqq T_a \leqq$900° C.; wherein the temperature $T_{na}$ of a steel sheet having a composition bearing no austenite phase on the entrance side of a hot finish rolling mill satisfies the equation 500° C.$\leqq T_{na} \leqq$900° C.; and wherein the total rolling reduction of said steel sheet by hot finish rolling is at least 30%.

5. A method of producing a magnetic steel sheet according to claim 4, wherein the ratio of the thickness reduction strain rate Z to the rolling reduction R in a hot finish rolling stand satisfies the following formula 1:

$$Z/R \geqq 0.51-0.04\,[Si] \qquad \text{Formula 1,}$$

wherein the rolling reduction in each rolling stand of a finish rolling mill, R (%)=$(1-t/t_0)\times 100$;

the thickness reduction strain rate, Z ($s^{-1}$)=$\ln(t_0/t)/[\{(d/2)\times\cos^{-1}((d-t_0+t)/d)\}/\{V\times 1000/60\}]$;

$t_0$ and t represent thicknesses (mm) on the entrance side and delivery side of each rolling stand;

d represents outer diameter (mm) of a work roll of each stand;

V represents carrying velocity (m/min) of a steel sheet on the delivery side of each stand.

6. A method of producing a magnetic steel sheet according to claim 4, wherein a first stand of a hot finish rolling mill reduces said steel sheet by 15% to 30%.

7. A method of producing a magnetic steel sheet according to claim 4, wherein said steel sheet undergoes total rolling reduction in hot finish rolling of 70% to 90%, and wherein average interlayer spacing of unrecrystallized elongated ferrite grains in said steel sheet on a delivery side of a final stand of a hot finish rolling mill is 250 $\mu$m or more.

8. A method of producing a magnetic steel sheet according to claim 4, wherein said hot rough rolled steel sheet at the entrance side of the first stand of the hot finish rolling mill has a ferrite single phase structure, wherein said steel sheet has an effective accumulated strain (Q) at an entrance side of a final stand of a hot finish rolling mill of 1.0 or more, wherein said steel sheet undergoes rolling reduction in said final stand of said hot finish rolling mill of 20% or more, and wherein said effective accumulated strain (Q) of said steel sheet is defined by Formula 2 in consideration of release of strain energy due to recovery between stands:

$$Q = \sum_{i=1}^{f-1} \epsilon i(0)\ \exp(-(t_i/\tau R)^{0.1}) \qquad \text{Formula 2}$$

wherein:

$\tau R = 7\times 10^{-27}\cdot\exp(65110\times Ti)$;

$\epsilon i(0)$ represents strain on said steel sheet in ith stand of said finish hot rolling mill;

ti represents time (sec.) from the ith stand to the final stand of said finish hot rolling mill;

f represents the total number of stands which constitute said finish hot rolling mill; and Ti represents the rolling temperature (K) of said steel sheet in the ith stand.

* * * * *

UNITED STATES PATENT AND TRADEMARK OFFICE

CERTIFICATE OF CORRECTION

PATENT NO. : 6,322,639 B1
DATED : November 27, 2001
INVENTOR(S) : Matsuzaki et al.

It is certified that error appears in the above-identified patent and that said Letters Patent is hereby corrected as shown below:

Column 25,
Table 3, at the subheading "Z/R ratio", at "Steel type i", please change "9.51" to -- 0.51 --.

Column 28,
Please insert the following table after "Table 6-1":

Table 6-2

| Steel No. | Slab No. | Heating condition | | Finish milling condition | | | | | | Ratio of integrated intensity of (015)[001] before cold rolling to random structure | Rolling reduction of cold rolling (%) | |
|---|---|---|---|---|---|---|---|---|---|---|---|---|
| | | Slab heating temperature (°C) | Heating or heat insulation before finish milling (°C) | Finisher entrance temperature (°C) | Ar1 transformation temperature (°C) | Volume fraction of equiaxed ferrite grains (%) | Average ferrite grain size (μm) | Volume fraction of grains of 100 μm or less (%) | Minimum Z/R ratio | | | |
| 25 | 11 | 1120 | – | 960 | – | 60 | 700 | 10 | 0.20 | 2.2 | 85 | C |
| 26 | 12 | 1200 | – | 820 | – | 100 | 440 | 0 | 0.55 | 6.5 | 65 | A |
| 27 | 13 | 1200 | – | 850 | – | 95 | 850 | 0 | 0.50 | 7.0 | 60 | |
| 28 | 14 | 1200 | – | 850 | – | 95 | 850 | 0 | 0.45 | 5.0 | 60 | |
| 29 | 15 | 1200 | – | 850 | – | 95 | 750 | 0 | 0.50 | 4.5 | 60 | |
| 30 | 16 | 1200 | – | 850 | – | 95 | 850 | 0 | 0.55 | 4.0 | 60 | |
| 31 | 17 | 1200 | – | 850 | – | 85 | 800 | 0 | 0.45 | 3.8 | 60 | |
| 32 | 18 | 1200 | – | 850 | 960 | 90 | 400 | 0 | 0.55 | 0.05 | 60 | |
| 33 | 19 | 1200 | – | 850 | 990 | 95 | 550 | 0 | 0.45 | 3.5 | 60 | |
| 34 | 20 | 1200 | – | 850 | – | 95 | 800 | 0 | 0.55 | 7.5 | 60 | |
| 35 | 21 | 1200 | – | 850 | – | 100 | 600 | 0 | 0.50 | 4.0 | 60 | |
| 36 | 22 | 1200 | – | 850 | – | 100 | 900 | 0 | 0.45 | 7.4 | 60 | |
| 37 | 23 | 1200 | – | 850 | – | 95 | 950 | 0 | 0.50 | 7.3 | 60 | |
| 38 | 24 | 1200 | – | 850 | – | 100 | 850 | 0 | 0.55 | 7.7 | 60 | |
| 39 | 25 | 1200 | – | 850 | – | 100 | 950 | 0 | 0.55 | 3.8 | 60 | |
| 40 | 26 | 1200 | – | 850 | – | 95 | 900 | 0 | 0.45 | 7.6 | 60 | |
| 41 | 27 | 1200 | – | 850 | – | 100 | 800 | 0 | 0.50 | 7.5 | 60 | |
| 42 | 28 | 1200 | – | 850 | – | 100 | 850 | 0 | 0.45 | 3.4 | 60 | |
| 43 | 29 | 1200 | – | 850 | – | 95 | 750 | 0 | 0.50 | 7.5 | 60 | |

A: Example of this invention, B: Comparative Example, C: Conventional Example

UNITED STATES PATENT AND TRADEMARK OFFICE

CERTIFICATE OF CORRECTION

PATENT NO. : 6,322,639 B1
DATED : November 27, 2001
INVENTOR(S) : Matsuzaki et al.

It is certified that error appears in the above-identified patent and that said Letters Patent is hereby corrected as shown below:

Column 37,
At "Table 13" in the heading " Ratio to random structure" at the subheading "(015) [100]" please delete "≥3.0".
At "Table 13" in the heading " Ratio to random structure" at the subheading "(100) [011]" please delete "≥2.0".
At "Table 13" in the heading " Ratio to random structure" at the subheading Goss (011) [100]" please delete "2.0~10".
At "Table 13" in the heading " Ratio to random structure" at the subheading "<111> //ND" please delete "≤2.0".

Signed and Sealed this

Twenty-fifth Day of June, 2002

*Attest:*

*Attesting Officer*

JAMES E. ROGAN
*Director of the United States Patent and Trademark Office*